US005463845A

United States Patent [19]

Gwiazdon et al.

[11] Patent Number: 5,463,845

[45] Date of Patent: Nov. 7, 1995

[54] APPARATUS FOR FOLDING, FILLING, AND SEALING MICROWAVE POPCORN BAGS

[75] Inventors: Rodney K. Gwiazdon, St. Louis Park, Minn.; John E. Korte, Cedar Rapids, Iowa; Richard S. Deadmond, West Bend; Frank C. Starr, New Berlin, both of Wis.

[73] Assignee: General Mills, Inc., Minneapolis, Minn.

[21] Appl. No.: 164,739

[22] Filed: Dec. 10, 1993

[51] Int. Cl.[6] ..... B65B 43/14; B65B 43/54

[52] U.S. Cl. ..... 53/459; 53/250; 53/284.7; 53/468; 53/571

[58] Field of Search ..... 53/571, 570, 284.7, 53/562, 250, 249, 459, 469, 468

[56] References Cited

U.S. PATENT DOCUMENTS

| | | | |
|---|---|---|---|
| 1,071,853 | 9/1913 | Young | 493/444 |
| 1,249,042 | 12/1917 | Dexter et al. | 271/107 |
| 1,886,552 | 11/1932 | Joplin | 53/284.7 X |
| 1,909,319 | 5/1933 | Taylor | 53/284.7 X |
| 2,364,543 | 12/1944 | Moore | 53/482 |
| 2,925,695 | 2/1960 | Fry | 53/482 |
| 2,952,959 | 9/1960 | Piazze | 53/284.7 X |
| 3,462,070 | 8/1969 | Corella | 229/56 |
| 3,493,226 | 2/1970 | Weir | 493/449 |
| 3,503,179 | 3/1970 | Pierre | 53/386.1 |
| 3,570,751 | 3/1971 | Trewella | 229/66 |
| 3,608,709 | 9/1971 | Pike | 206/219 |
| 3,615,711 | 10/1971 | Markus et al. | 229/66 X |
| 3,632,104 | 1/1972 | Dufour | 493/444 |
| 3,720,559 | 3/1973 | Odom et al. | 53/482 |
| 3,745,892 | 7/1973 | Ganz | 493/125 |
| 3,788,035 | 1/1974 | Geisel | 53/282 |
| 3,854,385 | 12/1974 | Wallin | 493/124 |
| 3,955,334 | 5/1976 | Wild et al. | 53/571 |
| 4,019,305 | 4/1977 | McGhie et al. | 53/482 |
| 4,033,093 | 7/1977 | Mencacci | 53/571 X |

(List continued on next page.)

FOREIGN PATENT DOCUMENTS

| | | |
|---|---|---|
| 569335A | 5/1993 | European Pat. Off. . |
| 565303 | 11/1932 | Germany . |
| 635952 | 9/1936 | Germany . |
| 2714584 | 11/1978 | Germany . |

(List continued on next page.)

OTHER PUBLICATIONS

SIG Pouch Packaging Machine Type RF; SIG Swiss Industrial Company, CH–8212 Neuhausen Rhine Falls, Packaging Technology Division; Raymond Automation Company, Inc., Norwalk, Conn. (No Date).

*Primary Examiner*—James F. Coan

*Attorney, Agent, or Firm*—L. MeRoy Lillehaugen; John A. O'Toole; Alan D. Kamrath

[57] ABSTRACT

An apparatus (10) is disclosed including fixtures (32) mounted to carrier bars (30) removably secured to roller chains (24) extending in parallelogram-shaped closed loops. In a first, vertical portion of the closed loops, bags (12) are loaded into the fixtures (32) in a folded condition by a loading device (50). Guides (274) prevent the bags (12) from moving from the fixtures (32) when the fixtures (32) move from the first, vertical portion to a second, horizontal portion. The bags (12) are opened by suction cups (104, 106) and filled with product and then collapsed and sealed in the horizontal portion. Guides (184) prevent the bags (12) from moving from the fixtures (32) when the fixtures (32) move from the second, horizontal portion to a third, vertical portion and bend the portions of the bags (12) extending out of the fixtures (32) at a nonlinear angle to the fixtures (32). The bags (12) are ejected from the fixtures (32) in the third, vertical portion by reciprocal pushing plates (172, 174). The bags (12) are ejected into pockets (186). Lugs (230) extending from lands (228) push the bags (12) from the pockets (186) in an inverted position as the lands (228) move from an inner position to an outer position. The free ends of fingers (294) abut with the bags (12) as the lands (228) move from the outer position to the inner position to position the bags (12) on a conveyor (200) and under slide bars (240).

44 Claims, 16 Drawing Sheets

U.S. PATENT DOCUMENTS

| | | | |
|---|---|---|---|
| 4,061,327 | 12/1977 | Blessing | 493/457 |
| 4,084,391 | 4/1978 | Williams, Sr. et al. | 493/457 |
| 4,108,300 | 8/1978 | Hayase et al. | 53/386.1 |
| 4,201,118 | 5/1980 | Calvert et al. | 493/125 |
| 4,257,209 | 3/1981 | Tetenborg et al. | 53/375.7 |
| 4,257,210 | 3/1981 | Tetenborg et al. | 53/375.7 |
| 4,320,615 | 3/1982 | Gmur | 53/386.1 |
| 4,337,862 | 7/1982 | Suter | 206/632 |
| 4,348,853 | 9/1982 | Morse et al. | 53/571 |
| 4,450,180 | 5/1984 | Watkins | 426/107 |
| 4,548,826 | 10/1985 | Watkins | 426/394 |
| 4,604,854 | 8/1986 | Andreas | 53/552 |
| 4,621,480 | 11/1986 | Aiuola et al. | 53/234 |
| 4,669,249 | 6/1987 | Aiuola et al. | 53/234 |
| 4,691,374 | 9/1987 | Watkins et al. | 383/104 |
| 4,735,513 | 4/1988 | Watkins et al. | 383/116 |
| 4,845,924 | 7/1989 | Focke et al. | 53/234 |
| 4,861,325 | 8/1989 | DiMarzio et al. | 493/124 |
| 4,873,815 | 10/1989 | Tetenborg et al. | 53/571 |
| 4,878,765 | 11/1989 | Watkins et al. | 383/116 |
| 4,890,439 | 1/1990 | Smart et al. | 53/410 |
| 5,044,777 | 9/1991 | Watkins et al. | 383/100 |
| 5,171,950 | 12/1992 | Brauner et al. | 219/10.55 E |
| 5,180,357 | 1/1993 | Marzullo | 493/420 |
| 5,269,117 | 12/1993 | Boriani et al. | 53/234 |

FOREIGN PATENT DOCUMENTS

| | | | |
|---|---|---|---|
| 8213834 | 5/1981 | Germany | 53/567 |
| 0002123 | 5/1976 | Japan | 493/457 |
| 9315976 | 8/1993 | WIPO . | |

9
9
10
10
12
14
16
18
22
24
30
32
34
36
37
38
40
42
44
46
48
49
60
104
105
106
108
110
112
114
118
120
280

10
12
12
14
16
18
22
24
32
60
104
106
108
110
112
114
116
118
120
122
126
128
132
274
276
278
280

10
286
296
288
290
238
292
240
190
196
198
12
200
218
220
192
194
186
230
228
226
188
224
222
236
232
16
14
22
184
60
28
29
30
32
34
38
40
42
44
46
48
49
24
172
178
174
175
170
177
179
180
182

10
60
186
188
190
192
194
196
198
200
238
240
286
288
290
292
294
296
298
300
302
304

APPARATUS FOR FOLDING, FILLING, AND SEALING MICROWAVE POPCORN BAGS

BACKGROUND

The present invention generally relates to apparatus for filling and sealing bags, particularly to apparatus for filling and sealing bags including food products, more particularly to apparatus for folding, filling, and sealing bags, and specifically to apparatus for folding, filling, and sealing microwave popcorn bags.

Popcorn is a highly popular snack food item. In the past, the at-home preparation of popcorn by the consumer involved adding kernel popcorn plus a cooking oil to a covered pot and heating until the popcorn kernels popped to make popcorn. As used herein, "kernel popcorn" refers to unpopped popcorn. The noun "popcorn" or synonymously "popped popcorn" refers herein to popped kernel popcorn. The adjective "popcorn" can refer to either.

More recently, microwave popcorn products have become extremely popular. At present, in the United States of America, over 70 different brands of microwave popcorn products are available. In general, the more popular microwave popcorn products comprise an expandable paper bag containing a charge of kernel popcorn, fat and salt. The microwave popcorn article is adapted to be heated in a microwave oven for three to five minutes to produce the popped popcorn. More recently, improved microwave popcorn articles have been fabricated employing a metallized susceptor which facilitates the heating of the popcorn-fat charge and which, in turn, leads desirably to increases in popcorn volume and decreases in unpopped kernels. Microwave popcorn articles of this type are described in detail in, for example, U.S. Pat. No. 4,450,180 (issued May 22, 1984 to J. D. Watkins and incorporated herein by reference).

The prior art is replete with various apparatus and methods for filling and sealing microwave popcorn bags and in some cases folding the bag generally into a central portion having first and second wing portions extending from opposite ends thereof from folds. For example, U.S. Pat. Nos. 4,450,180; 4,548,826; 4,604,854; and 5,171,950 show techniques for filling and sealing microwave popcorn bags. Particularly, the charge of popcorn, fat and salt could be dropped as a prefabricated toroid- or doughnut-shaped piece into an open end of the bag prior to its sealing. More recently, the popcorn, fat in the form of a slurry, and salt are filled in the open end of the bag prior to its sealing. However, changes in the marketing of microwave popcorn have created demand for improved techniques for filling and sealing microwave popcorn bags. Specifically, with the increasing competitiveness of the microwave popcorn business, a need exists for apparatus and methods which achieve higher output speeds in "bags per minute" while reducing the amount of labor, downtime, and floor space required. Additionally, with the reduction in the amount of material and/or layers utilized in the formation of paper popcorn packages including a microwave susceptor such as shown and described in International Publication No. WO 93/15976 published on Aug. 19, 1993, a need exists for apparatus and methods which are capable of running bags of flimsy construction as well as reducing product and material damage. Additionally, with the introduction of various types and sizes of bags to meet particular market types and conditions and for enhancing product performance, a need exists for apparatus and methods which are capable of handling different sizes of bags such as single or multiple serving sizes, and/or different types such as gusseted or non-gusseted bags, and/or different configurations of bags.

SUMMARY

The present invention solves these needs and other problems in the field of filling, sealing, and/or folding microwave popcorn bags or the like by providing, in the most preferred form, a fixture for receipt of the bag and movable at intermittent positions in an operation direction along a closed loop shape having a first, generally vertical portion terminating in a second, generally horizontal portion in turn terminating in a third, generally vertical portion terminating in a fourth portion in turn terminating in the first portion, with the bag loaded into the fixture in the first portion, filled and sealed in the second portion, and ejected from the fixture in the third portion.

In another aspect of the present invention, the bag is prevented from moving from a fixture under centrifugal forces as the fixture moves in an operation direction between vertical and horizontal portions. In a first form, a guide holds the portion of the bag extending beyond the fixture at a nonlinear angle to the portion of the bag located in the fixture when the fixture is located in the vertical portion. In a second form of the present invention, a guide terminates in a vertical stop which abuts with the bottom of the bag adjacent the unsealed end at the first intermittent position in the horizontal portion.

In other aspects of the present invention, first and second fixture halves are held in a spaced relation, with each of the fixture halves including a side plate and a bottom plate extending generally perpendicular to the side plate, a support plate of a rectangular configuration extending generally perpendicular to the side plate and to the bottom plate, and an L-shaped abutment having a first leg extending generally perpendicular to the side plate for abutting with the side edges of a bag and a second leg extending generally perpendicular to the bottom plate, with the support plate being spaced from the L-shaped abutment to define a slot therebetween for slideable receipt of the side edges of the bag, with the bottom of the bag being deformable outward between the abutments of the first and second fixture halves with the first and second side edges of the bag abutting with the abutments.

It is thus an object of the present invention to provide a novel apparatus for filling and sealing bags.

It is further an object of the present invention to provide such a novel bag-filling and sealing apparatus achieving higher output speeds in "bags per minute" than current technology.

It is further an object of the present invention to provide such a novel bag-filling and sealing apparatus providing positive control of the bags during opening, loading, closing, and folding.

It is further an object of the present invention to provide such a novel bag-filling and sealing apparatus capable of running various types and sizes of bags including gusseted and non-gusseted bags, multi- or single-ply paper bags, or bags of flimsy-type structure.

It is further an object of the present invention to provide such a novel bag-filling and sealing apparatus which is very compact, minimizing floor surface and work space required.

It is further an object of the present invention to provide such a novel bag-filling and sealing apparatus which is easily accessible from the floor for trouble shooting, maintenance, and the like.

It is further an object of the present invention to provide such a novel bag-filling and sealing apparatus allowing easy changeover for different sized bags and for reducing down time.

It is further an object of the present invention to provide such a novel bag-filling and sealing apparatus reducing product loss and which separates defective bags.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
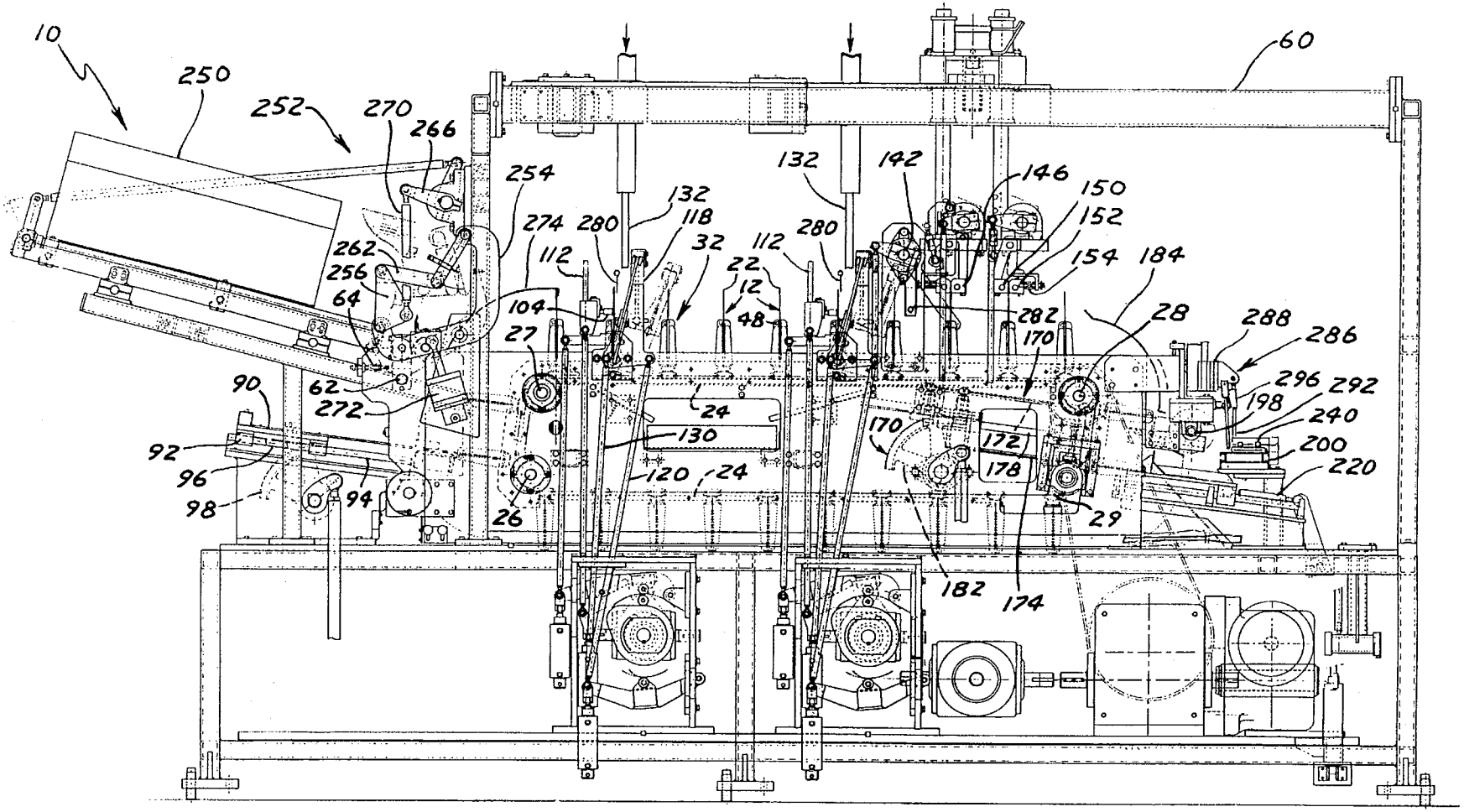
FIG. 1 shows a side view of a microwave popcorn bag folding, filling, and sealing apparatus according to the preferred teachings of the present invention.
Figure 2:
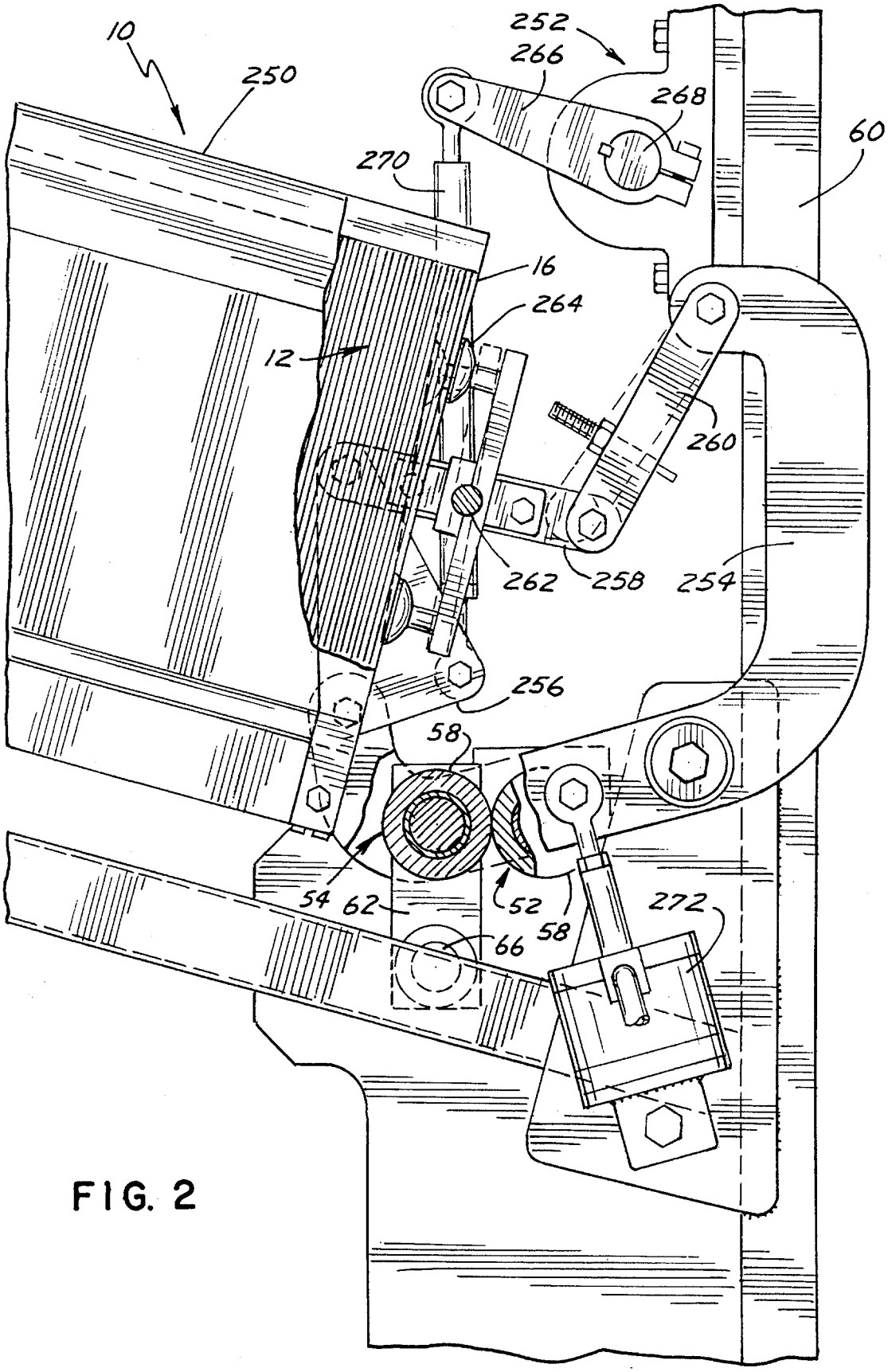
FIG. 2 shows an enlarged, side view of the microwave popcorn bag folding and loading device of the apparatus of FIG. 1, with portions broken away to show constructional details.
Figure 3:
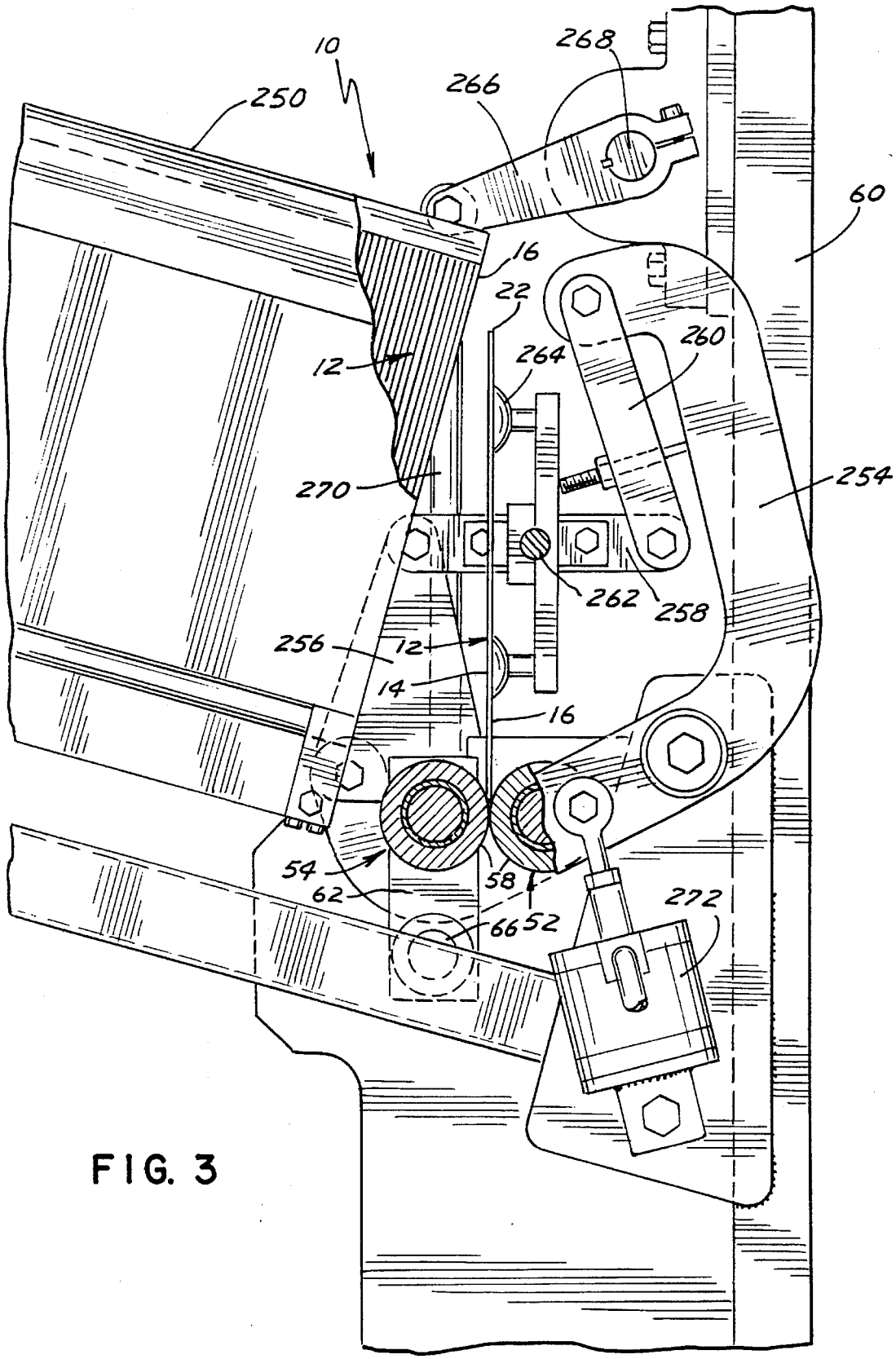
FIG. 3 shows an enlarged, side view of the microwave popcorn bag folding and loading device of FIG. 2 of the apparatus of FIG. 1 in a different position, with portions broken away to show constructional details.
Figure 4:
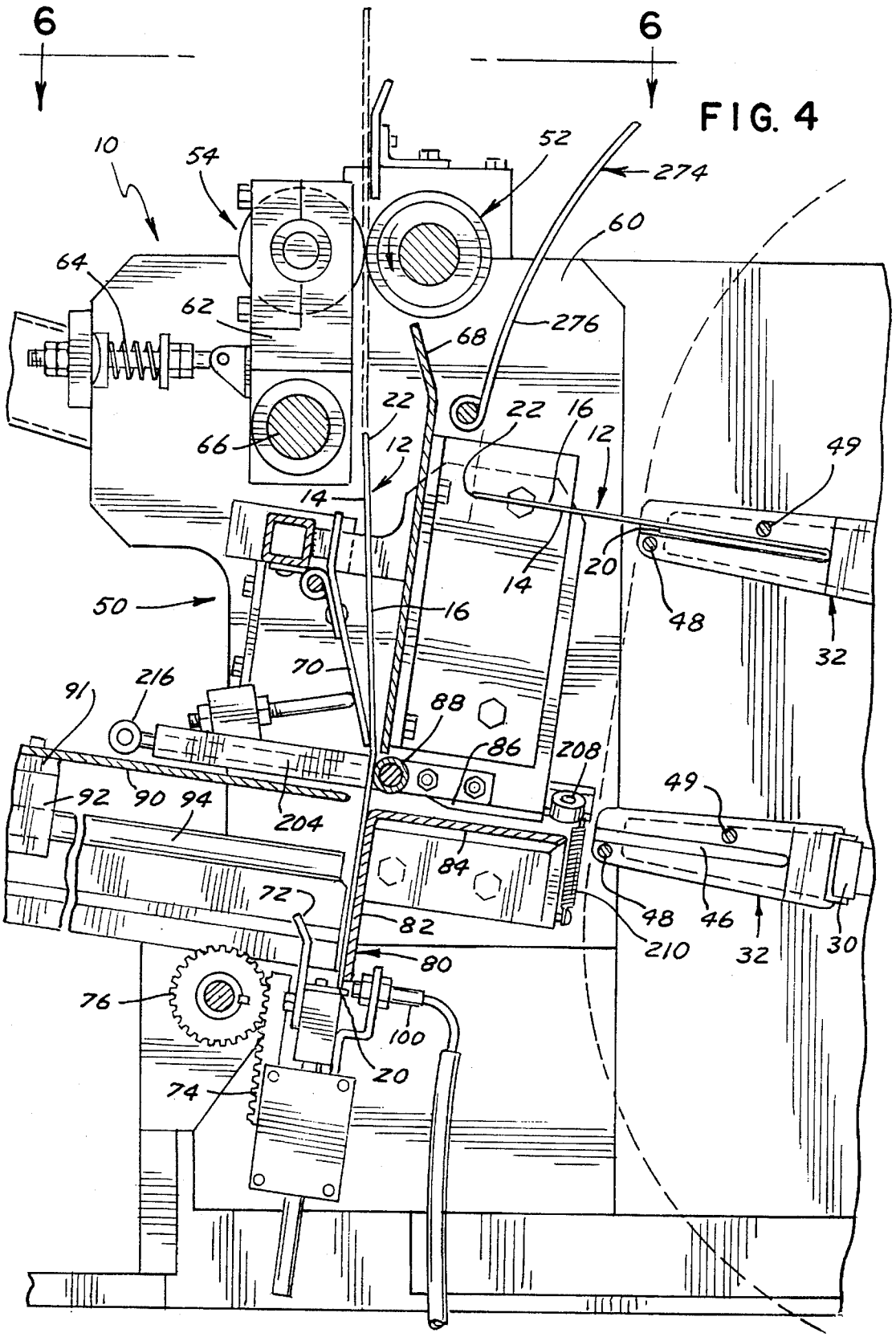
FIG. 4 shows an enlarged, cross sectional view of the microwave popcorn bag folding and loading device of the apparatus of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "back", "rear", "upper", "lower", "height", "width", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

An apparatus for filling and sealing bags 12 according to the preferred teachings of the present invention is shown in the drawings and generally designated 10. In the most preferred form, bags 12 are of the current type for the marketing of microwave popcorn and each include a top 14, a bottom 16 including the microwave susceptor, first and second gusseted sides 18, a first, lower, sealed end 20, and a second, upper, unsealed end 22. In the most preferred form, bottom 16 has a width less than top 14. Each side 18 includes a top gusset pivotally connected to top 14 about a fold line and includes a bottom gusset pivotally connected to bottom 16 about a fold line and also pivotally connected to the corresponding top gusset. It should be noted that bags 12 can be of other types and varieties than bags 12 as shown, such as but not limited to bags 12 where top 14 and bottom 16 are of equal or different widths, nongusseted bags 12, or the like. Also, bags 12 can be formed of various types of materials including paper of either multi-ply or single-ply variety, plastic, and like materials including flimsy-type materials.

Apparatus 10 generally includes at least first and second roller chains 24 arranged as closed loops extending around four sets of sprockets 26–29 in a generally parallelogram shape. Multiple carrier bars 30 are provided including first portions secured to roller chains 24 at equal circumferential spacing along the closed loops. Each carrier bar 30 includes a second portion having a plurality of bag-holding fixtures 32 secured thereto corresponding to the number of lanes of bags 12 which are being filled and sealed in apparatus 10, with 4 lanes being provided in apparatus 10 and 4 fixtures 32 being provided on each carrier bar 30 in the preferred form.

Figure 5:
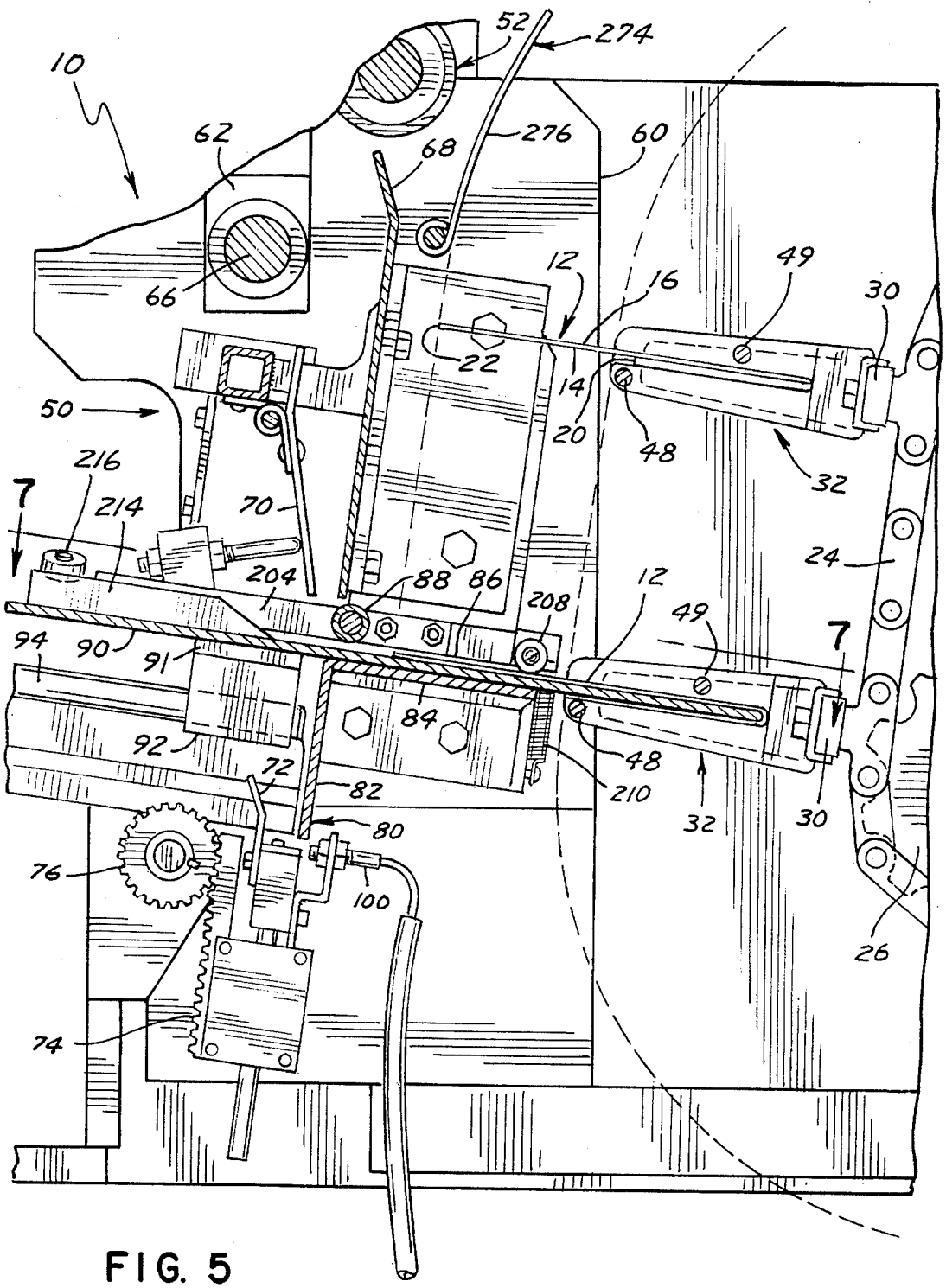
FIG. 5 shows an enlarged, cross sectional view of the microwave popcorn bag folding and loading device of FIG. 4 of the apparatus of FIG. 1 in a different position.
Figure 6:
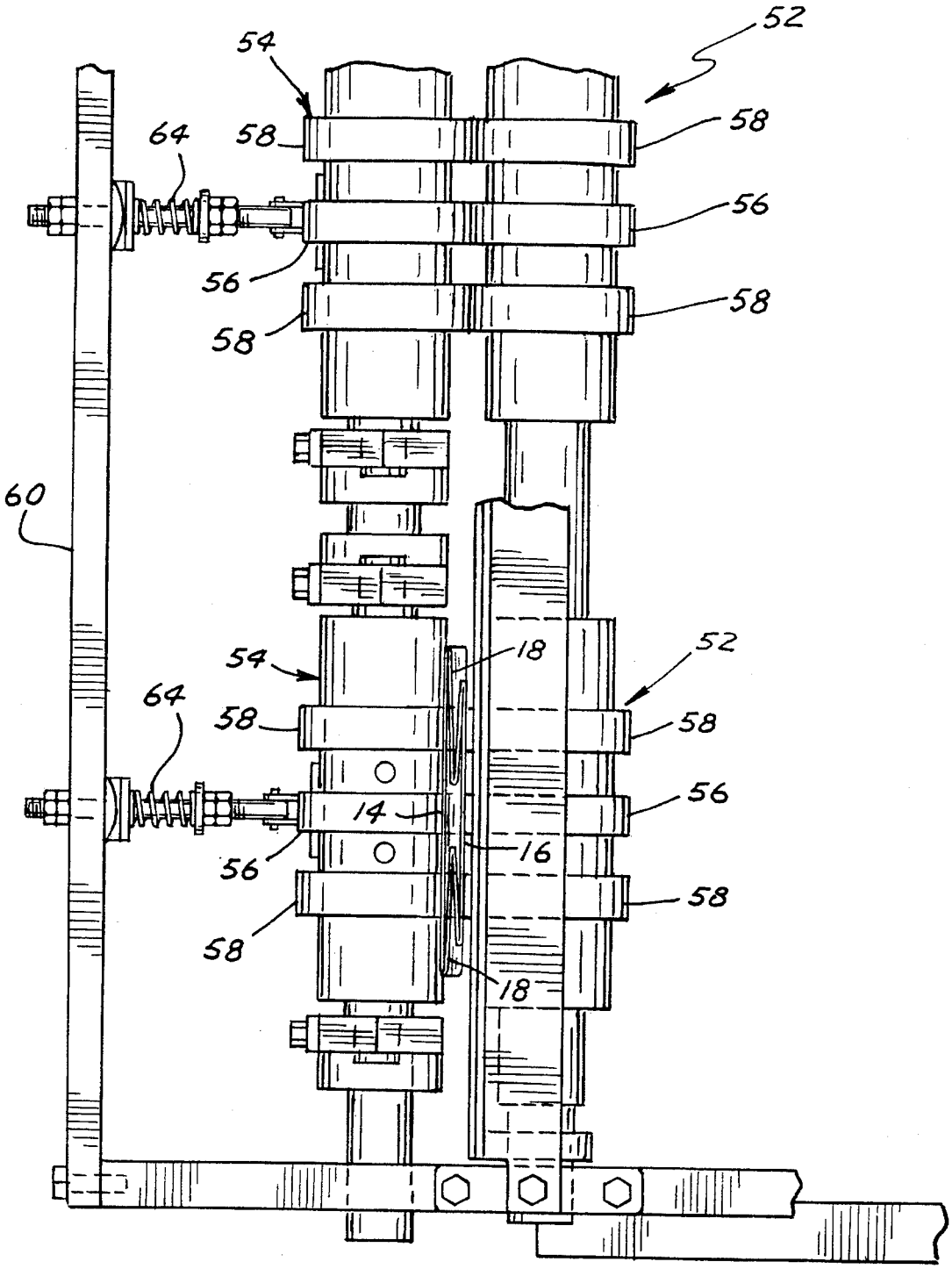
FIG. 6 shows a cross sectional view of the microwave popcorn bag folding and loading device of the apparatus of FIG. 1 according to section line 6—6 of FIG. 4.
Figure 7:
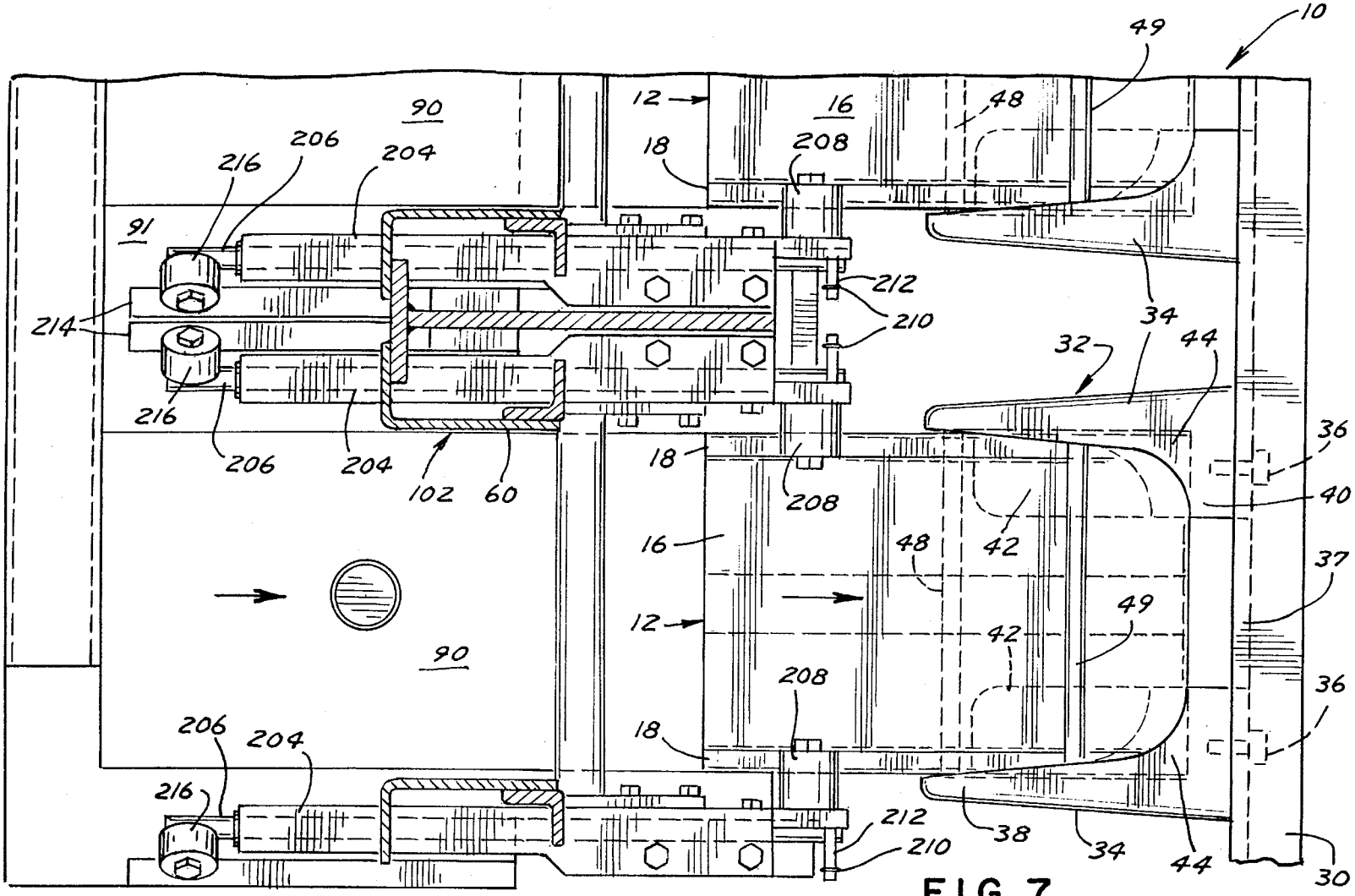
FIG. 7 shows a cross sectional view of the microwave popcorn bag folding and loading device of the apparatus of FIG. 1 according to section line 7—7 of FIG. 5.
Figures 8, 9:
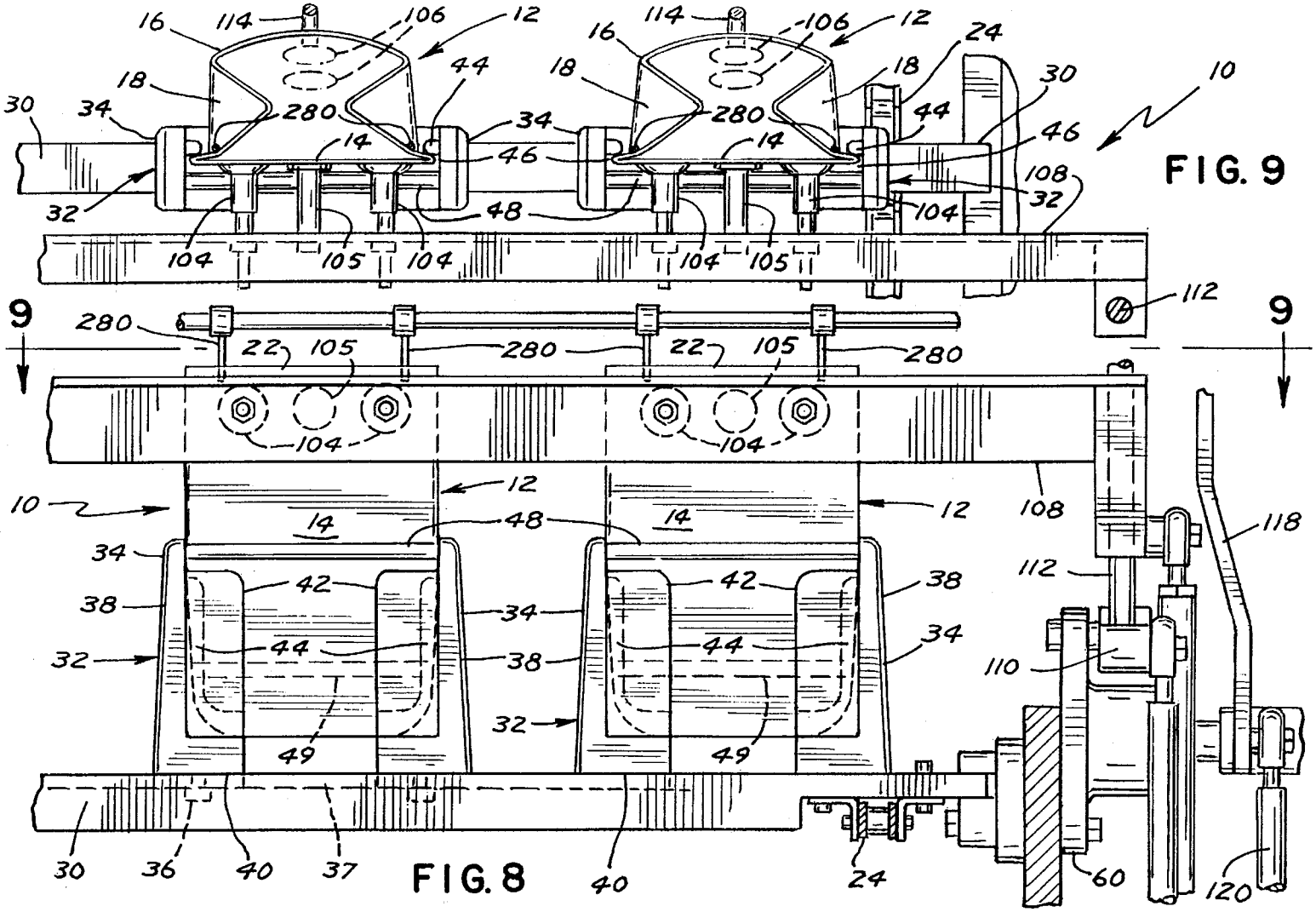
FIG. 8 shows an enlarged, partial, cross sectional view of a microwave popcorn bag opening device of the apparatus of FIG. 1.
FIG. 9 shows a cross sectional view of the microwave popcorn bag opening device of the apparatus of FIG. 1 according to section line 9—9 of FIG. 8.
Figures 10, 11:
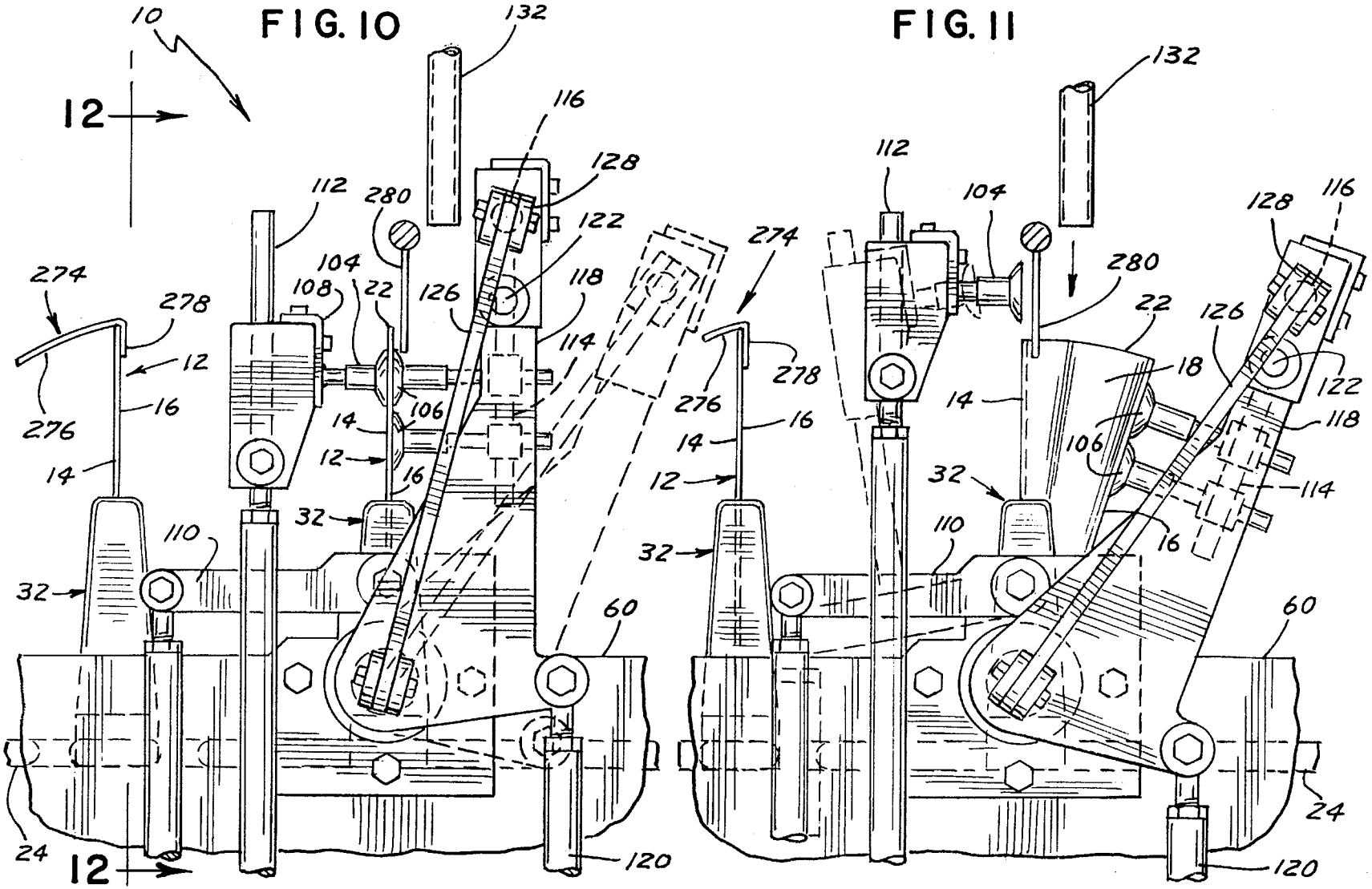
FIG. 10 shows a partial, cross sectional view of the microwave popcorn bag opening device of FIG. 8 of the apparatus of FIG. 1 in an attachment position.
FIG. 11 shows a partial, cross sectional view of the microwave popcorn bag opening device of FIG. 8 of the apparatus of FIG. 1 in an open position.
Figure 12:
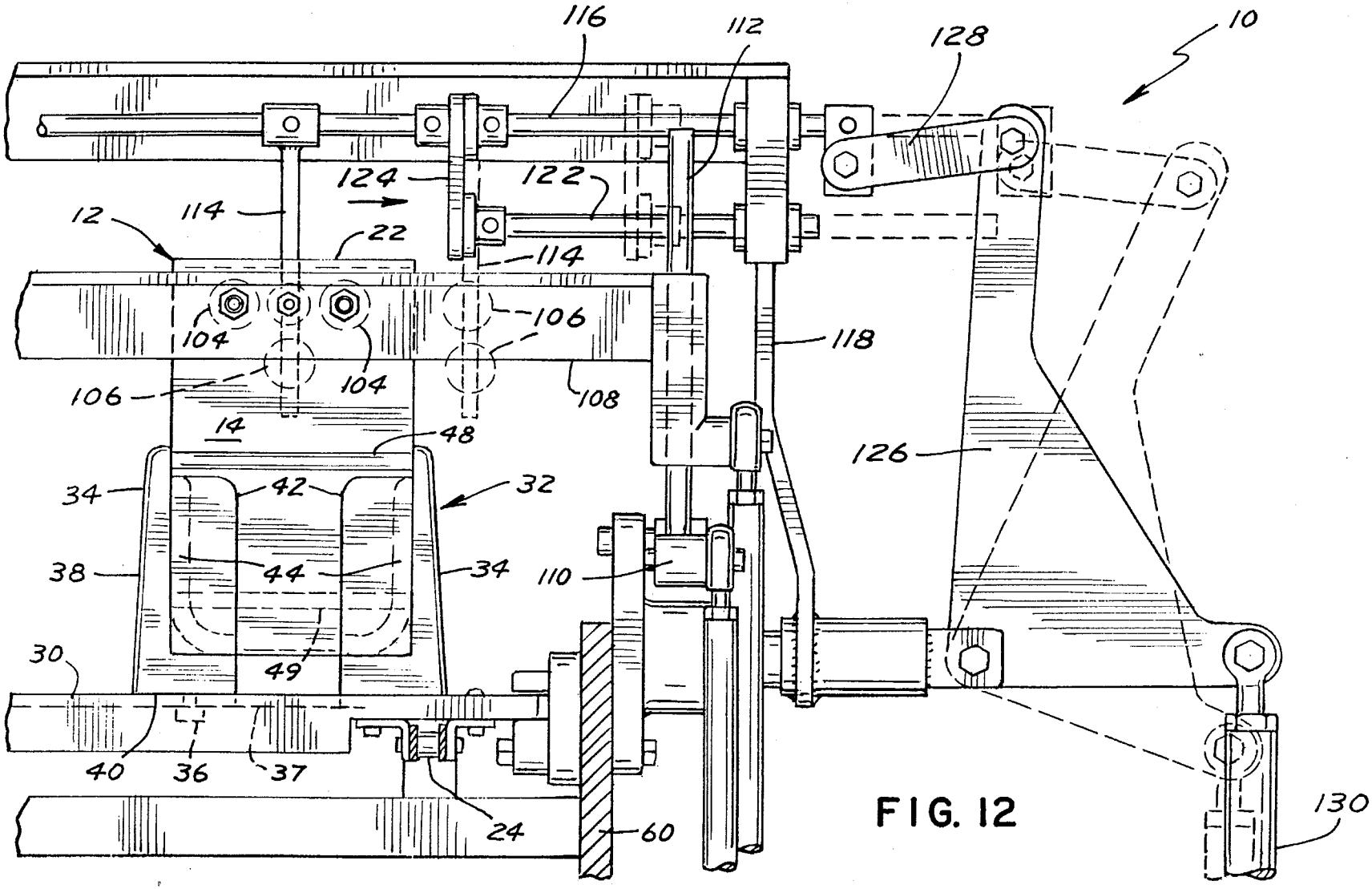
FIG. 12 shows a cross sectional view of the microwave popcorn bag opening device of the apparatus of FIG. 1 according to section line 12—12 of FIG. 10.
Figure 13:
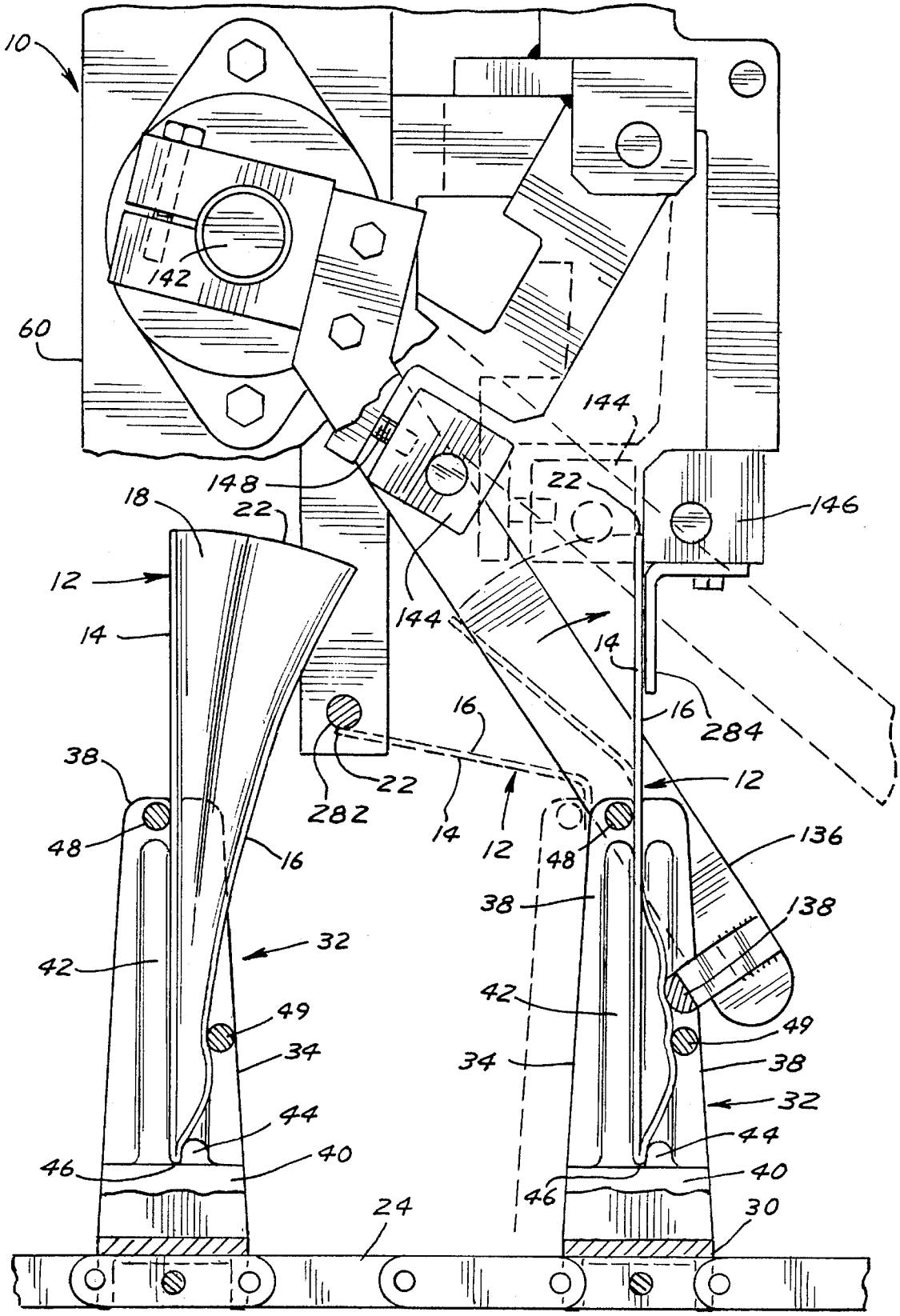
FIG. 13 shows an enlarged cross sectional view of a microwave popcorn bag collapsing device of the apparatus of FIG. 1.
Figure 14:
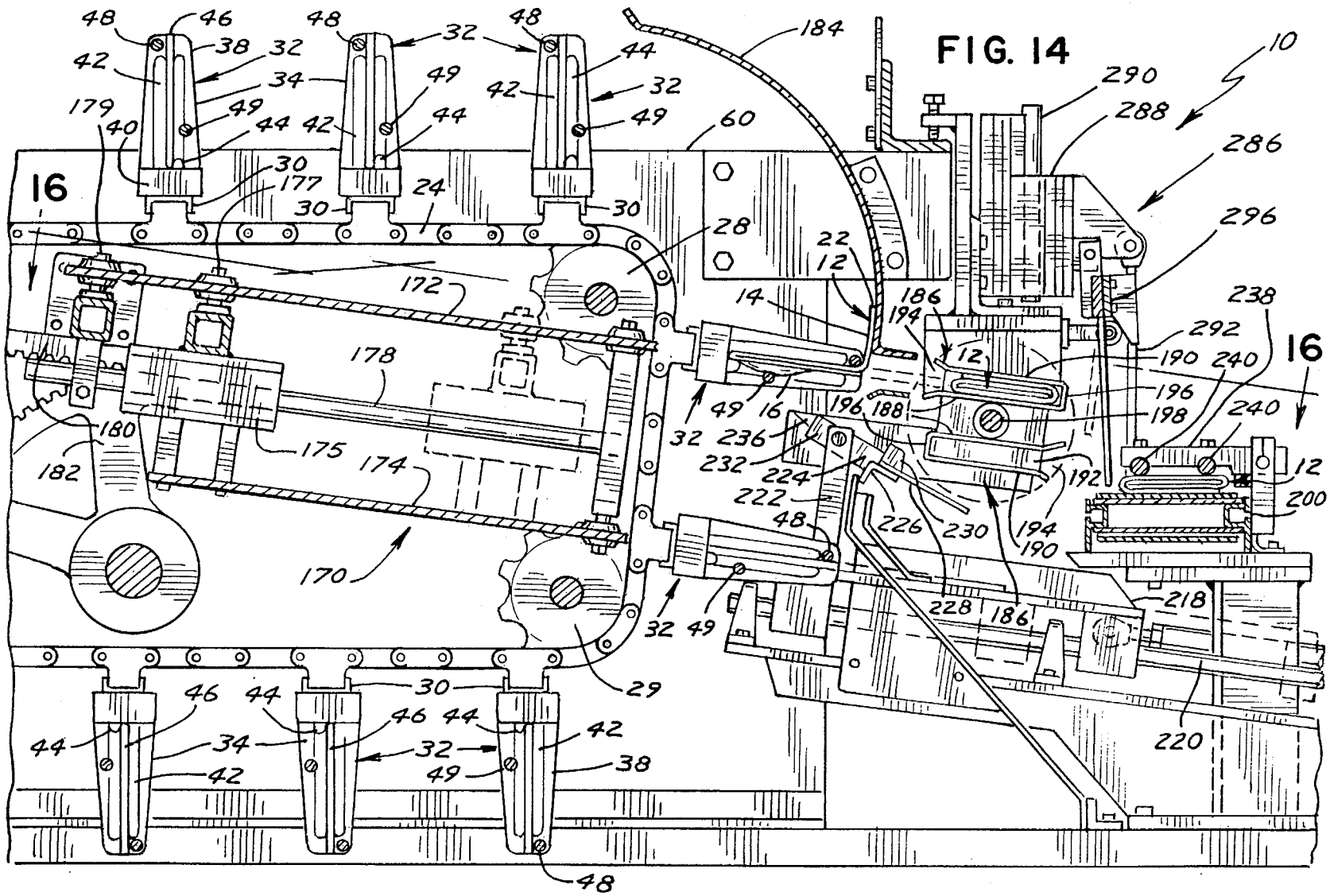
FIG. 14 shows an enlarged cross sectional view of the microwave popcorn bag folding and ejecting device of the apparatus of FIG. 1.
Figure 15:
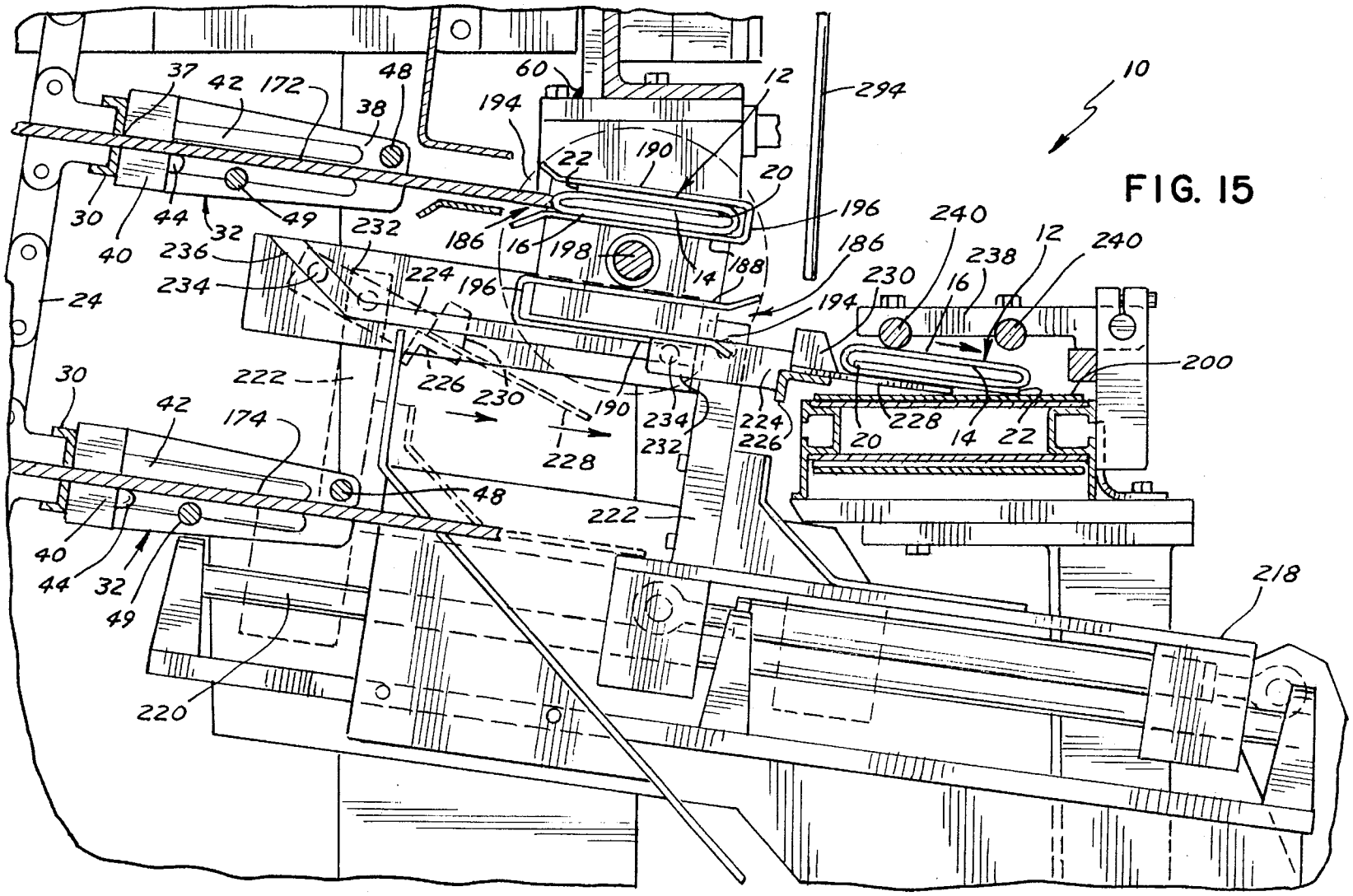
FIG. 15 shows a partial, enlarged, cross sectional view of the microwave popcorn folding and ejecting device of FIG. 14 of the apparatus of FIG. 1.
Figure 16:
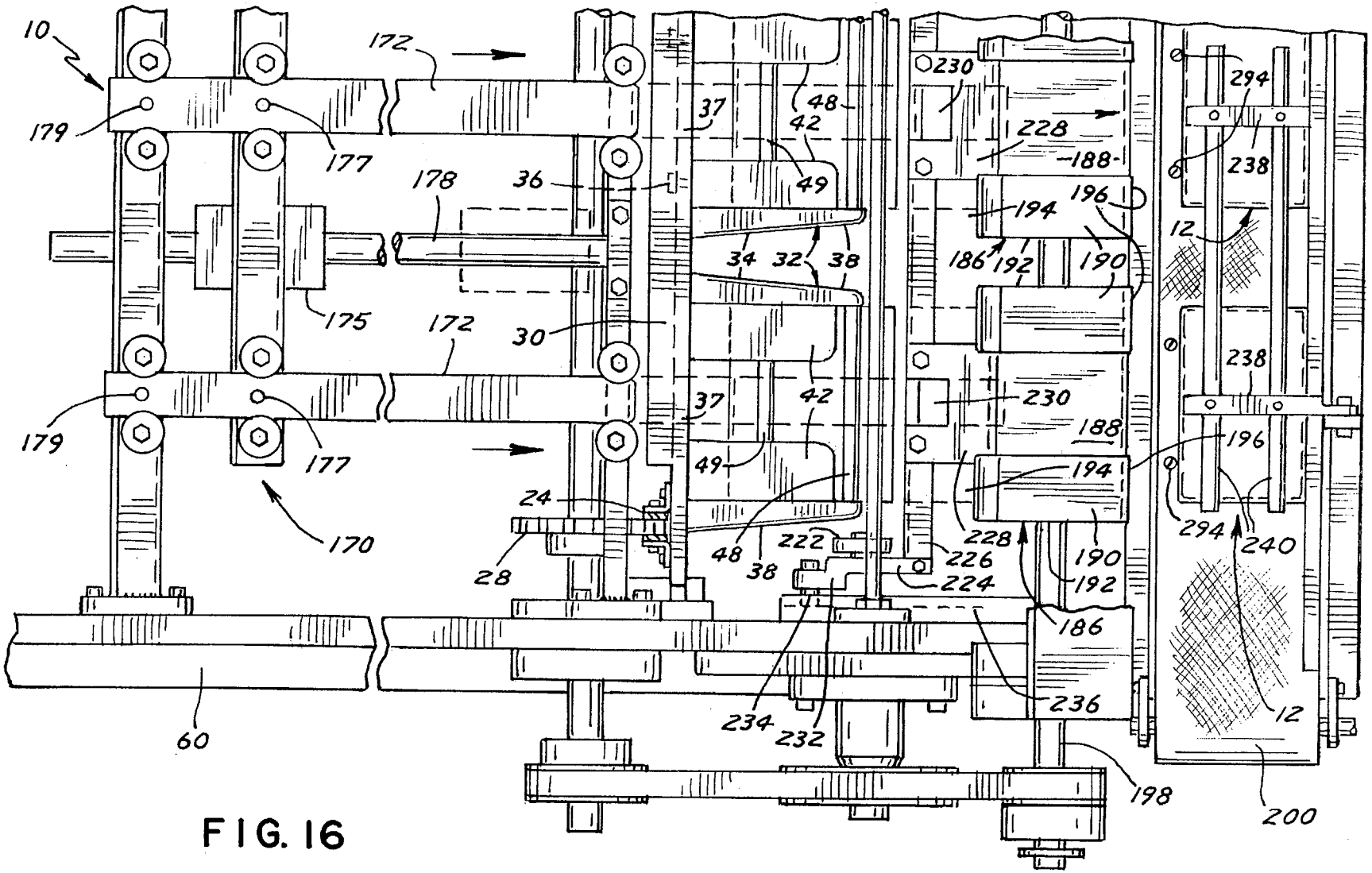
FIG. 16 shows a cross sectional view of the microwave popcorn bag folding and ejecting device of the apparatus of FIG. 1 according to section line 16—16 of FIG. 14.
Figure 17:
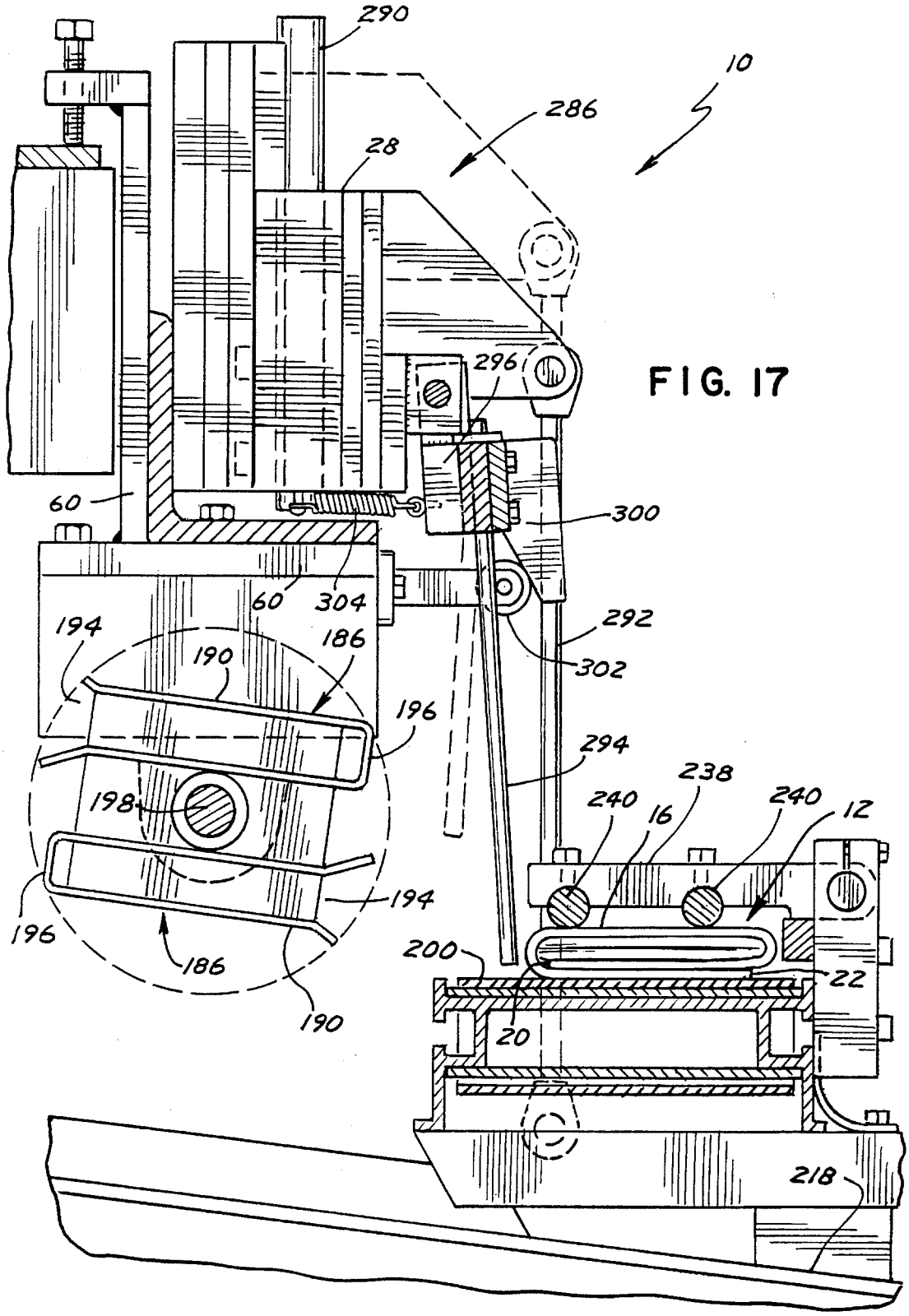
FIG. 17 shows a partial, cross sectional view of the microwave popcorn bag folding and ejecting device of FIG. 14 of the apparatus of FIG. 1.
Figures 18, 19:
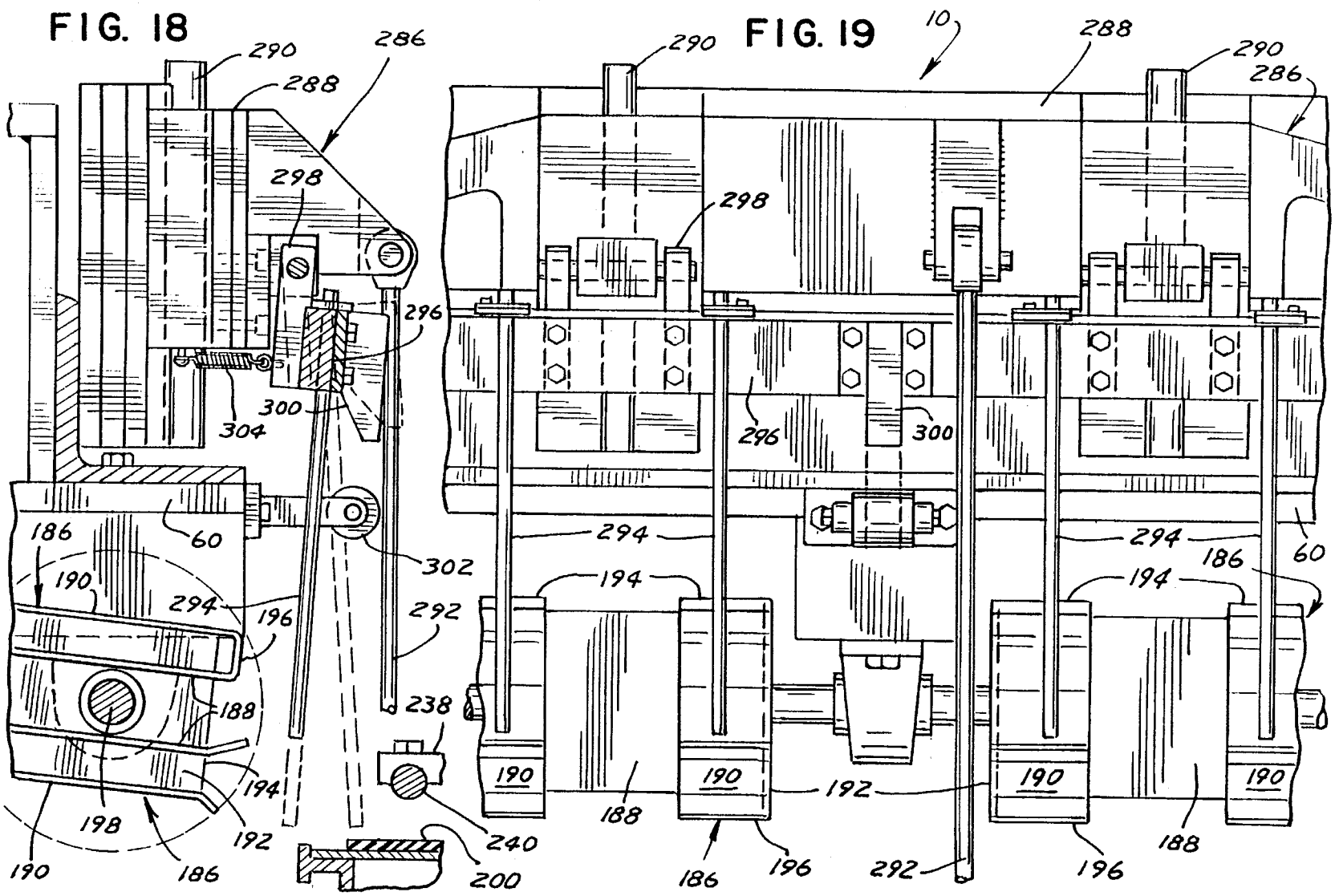
FIG. 18 shows a partial, enlarged, cross sectional view of the microwave popcorn bag folding and ejecting device of FIG. 14 of the apparatus of FIG. 1.
FIG. 19 shows an end view of the microwave popcorn bag folding and ejecting device of FIG. 14 of the apparatus of FIG. 1.

The first and second portions of bars 30 are removably secured together such as by bolts as best seen in FIG. 5. It can then be appreciated that changeover for different sized bags can be easily accomplished and/or down time is reduced in the event of fixture contamination, breakage, or the like by simply replacing the second portions of bars 30 with fixtures 32 secured thereon. Any cleaning or repair can be accomplished while the second portions of bars 30 and fixtures 32 secured thereon are removed from apparatus 10 and as apparatus 10 continues to operate with other, replacement, second portions of bars 30 and fixtures 32 secured thereon being secured to the first portions of bars 30 secured to roller chains 24.

In the most preferred form, fixtures 32 each include first and second fixture halves 34 secured in a spaced relation to the second portions of bars 30 by suitable means such as bolts 36. An aperture 37 is formed in bars 30 intermediate halves 34 of each fixture 32. Each half 34 includes a side plate 38 and a bottom plate 40 extending generally perpendicular to the bottom ends of plate 38. Each half 34 further includes a support plate 42 of a generally rectangular configuration and extending generally perpendicular to side plates 38 and bottom plate 40. Each half 34 further includes an abutment 44 of a generally L-shaped configuration having a first leg secured and extending generally perpendicular to plate 38 and a second leg secured to and extending generally perpendicular to plate 40. In the most preferred form, the first and second legs of abutment 44 include an arcuate portion at their interconnection. Abutment 44 has arcuate inside edges and provides a camming surface opposite to support plate 42. Support plate 42 and abutment 44 are generally parallel and spaced from each other and form a slot 46 therebetween for receiving the side edges of bag 12. Side plates 38 further include bores for slideably receiving the ends of a folding bar 48, with bar 48 being captured in the bores of side plates 38 of the first and second fixtures halves 34 forming each fixture 32. The forward extent of bar 48 is generally equal to the forward extent of support plates 42 of halves 34 of fixtures 32. The first legs of abutment 44 include bores for slideably receiving the ends of an expansion prevention bar 49, with bar 49 being captured in the bores of abutment 44 of the first and second fixture halves 34 forming each fixture 32.

It can then be appreciated that as roller chains 24 move around sprocket sets 26–29, bars 30 and fixtures 32 carried thereby are positioned along the generally parallelogram shape of the closed loop arrangement of roller chains 24, with chains 24 being movable in an operation direction intermittently by any suitable means in the most preferred form.

Apparatus 10 further includes a device 50 for loading bags 12 into fixtures 32, with device 50 folding bags 12 along a fold line as they are loaded into fixtures 32 in the preferred form, and with bags 12 folded into 1/3–2/3 portions in the most preferred form. Device 50 generally includes bag magazines 250 which hold a supply of bags 12 in a generally vertical but slanted condition for each lane of apparatus 10, with bags 12 in the most preferred form having lower ends 20 spaced horizontally outwardly from upper ends 22. An unloading device 252 is provided for removing the front bag 12 in each magazine 250 and placing it in a generally vertical condition. Device 252 includes first and second linkage assemblies on opposite sides of apparatus 10, with each having a generally C-shaped linkage 254 pivotally mounted intermediate its ends to frame 60. The lower, outer end of each C-shaped linkage 254 is pivotally mounted to the lower, outer corner of a triangular-shaped linkage 256. The upper corner of linkage 256 is pivotally mounted to a first end of a straight linkage 258. The second end of linkage 258 is pivotally mounted at an acute angle to the second end of a straight linkage 260. The first end of linkage 260 is pivotally mounted to the upper, inner end of C-shaped linkage 254. A lateral bar 262 extends between linkages 258 on opposite sides of apparatus 10 generally intermediate the ends of linkages 258. Suction cups 264 are attached to lateral bar 262 corresponding to magazines 250. A crank arm 266 has a first end mounted to a rotatable shaft 268. A straight linkage 270 is pivotally mounted to the second end of crank arm 266 and the inner, lower corner of triangular-shaped linkage 256, with the inner, lower corner of linkage 256 being in a nonlinear arrangement with the upper and lower, outer corners of linkage 256. Air cylinder bias members 272 are pivotally mounted to frame 60 and linkages 254 intermediate their lower, outer ends and the pivot to frame 60.

To remove bags 12 from magazines 250, shaft 268 is rotated by any suitable means such as a crank arm. Rotation of shaft 268 causes pivoting of crank arm 266 which in turn causes pivoting of triangular-shaped linkage 254 due to the pivotal interconnection therebetween by linkage 270. Pivoting of linkage 254 causes bar 262 to move to engage suction cups 264 to bags 12, and move bags 12 from a generally vertical but slanted condition from magazines 250 to a generally vertical condition in front of magazines 250, with the lower ends 20 located generally vertically below upper ends 22. In the most preferred form, bags 12 are released from suction cups 264 by discontinuing the vacuum to suction cups 264 and providing pressurized air thereto in the most preferred form to blow off and actively release bags 12 from suction cups 264.

Device 50 further generally includes first and second nip rollers 52 and 54. Rollers 52 and 54 each include a center wheel 56 and first and second edge wheels 58 located on opposite sides of and spaced from center wheel 56. Wheels 56 and 58 of rollers 52 and 54 abut and roll on each other for grabbing bags 12 from unloading device 252 (after release of vacuum and providing pressurized air to suction cups 264) and vertically feeding bags 12 downward. wheels 56 are located intermediate the side edges of bags 12 and intermediate the inside folds of the top and bottom gussets of sides 18. Wheels 58 are spaced inside the side edges of bag 12, outside of the inside folds of the top and bottom gussets of sides 18, and inside the folds of bottoms 16 and the bottom gussets of sides 18. Particularly, in the most preferred form, wheels 56 and 58 do not sandwich bags 12 at any of the folds between top 14, bottom 16, and sides 18 such that the folds are not sharply creased as bags 12 pass through rollers 52 and 54 and between wheels 56 and 58 thereof.

In the most preferred form, rollers 52 are rotatably mounted to frame 60 of apparatus 10 whereas rollers 54 are movably mounted relative to rollers 52. Specifically, rollers 54 are rotatably mounted to subframes 62 which are pivotally mounted about an axis 66 to frame 60. Subframes 62 are biased by springs 64 extending between frame 60 and subframes 62 for moving rollers 54 towards and resiliently holding rollers 54 against rollers 52. Thus, rollers 54 separate from rollers 52 in the event that more than one bag 12 should be simultaneously fed to the nip of rollers 52 and 54 in any particular lane in apparatus 10.

First, stationary guide flanges 68 are mounted to frame 60 vertically below rollers 52 and second, guide flanges 70 are mounted to frame 60 vertically below rollers 54 and axis 66. In the most preferred form, guide flanges 70 are openable to allow access to the area between flanges 68 and 70. Specifically, flanges 70 in the preferred form are mounted by hinges to a frame portion having a horizontal pivot axis located intermediate the upper and lower ends of flanges 70. Adjustable counterweights are secured to flanges 70 vertically below the horizontal pivot axis for biasing flanges 70 to pivot about the horizontal pivot axis until the upper ends of flanges 70 abut with the frame portion. Access can then be obtained by pivoting the desired flange 70 about the horizontal pivot axis against the bias of the counterweight, if desired, for example to remove jammed bags 12 located between flanges 68 and 70.

Bags 12 are fed vertically downward between flanges 68 and 70 by nip rollers 52 and 54 towards an adjustable bottom stop 72, with sealed ends 20 abutting with stop 72 in the lowermost position of bags 12 in the most preferred form. A rack gear 74 is secured to stop 72 parallel to the movement direction of bags 12 which is vertically downward in the most preferred form and is generally vertically movable by rotation of a spur gear 76. Gear 76 is rotatable about an axis which is perpendicular to the movement direction of bag 12 and specifically which is horizontal in the preferred form and is in gearing relation with rack gear 74. In the most preferred form, rotation of spur gear 76 can be mechanically stopped at set intervals corresponding to the standard lengths of bags 12 which are typically filled in apparatus 10.

Positioned above stop 72 and vertically below rollers 52 are L-shaped folding guides 80 having generally vertical legs 82 and generally horizontal legs 84. Located intermediate guides 80 and guide flanges 68 are folding guides 86 extending generally parallel to horizontal legs 84 of folding guides 80. Folding rollers 88 are located on guides 86 intermediate flanges 68 and legs 82.

Loading device 50 further includes a pushing or tucking plate 90 for each lane of fixtures 32. Plates 90 have an elongated length terminating in free, generally arcuate-shaped edges and have a width less than the spacing between abutments 44 of fixtues 32. Plates 90 are simultaneously horizontally movable between retracted positions and extended positions extending between horizontal legs 84 and folding guides 86. In the most preferred form, plates 90 are secured to a mount bar 91 in laterally spaced positions corresponding to fixtures 32 on carrier bars 30. Mount bar 91 is longitudinally movably mounted by first and second slide blocks 92 which are slideably mounted on support shafts 94. In the most preferred form, a rack gear 96 secured to mount bar 91 intermediate slide blocks 92 is moved by rotation of a spur gear 98 to slide blocks 92 on shafts 94 to longitudinally move mount bar 91 and plates 90 between their retracted and extended positions.

In operation of loading device 50 according to the most preferred teachings of the present invention and with plates 90 in their retracted positions, bags 12 are moved from a magazine or the like and positioned with ends 20 positioned above and into nip rollers 52 and 54 by unloading device 252. Rotation of nip rollers 52 and 54 grips bags 12 and pulls bags 12 downwardly between flanges 68 and 70 and drives bags 12 downward until ends 20 rest upon stop 72. In the most preferred form, a suitable sensor 100 is positioned to detect the presence of bag 12 in each of the lanes of apparatus 10. If a bag 12 is not detected in one or more of the lanes by sensor 100, operation of apparatus 10 can be modified as desired. For example, operation could be stopped until an operator checks why a bag 12 is not present, places a bag 12 in the previously omitted lane, and manually restarts operation. Alternately, operation of apparatus 10 can continue with the filling and sealing and other operations not being performed for the particular lane(s) where bags 12 are not detected during the normal operation of apparatus 10 for the other lanes, with operation of apparatus 10 being stopped only if bags 12 are not detected in a single lane for a particular number of cycles. With bags 12 resting upon stop 72, bags 12 extend vertically between vertical legs 82 and the free ends of shafts 94 and between flanges 68 and 70 and generally perpendicular to slots 46 of fixtures 32 and to tucking plates 90, with slots 46 located intermediate ends 20 and 22 of bags 12.

With one of the carrier bars 30 positioned in the vertical portion of the parallelogram shape of the closed loop with bag-holding fixtures 32 parallel to and in line with legs 84 and folding guides 86, plates 90 are moved from their retracted positions to their extended positions by sliding blocks 92 on shafts 94. With movement of plates 90, the free edges of plates 90 abut generally perpendicular with tops 14 of bags 12 above ends 20 such as about ⅓ above the total length between ends 20 and 22 when bags 12 in their commercialized form are folded into three generally equal portions. Adjustment of stop 72 can be made to accomodate bags 12 of different lengths so that plates 90 abut at the desired position on tops 14 of bags 12. Upon further movement of plates 90, bags 12 will then fold about the free edges of plates 90 in a generally U-shape and extend in a folded condition with tops 14 abutting on opposite sides of plates 90 and with bottoms 16 abutting with horizontal legs 84 and folding guides 86. with further movement of plates 90, bags 12 will be driven into slots 46 as they continue to slide with plates 90 into slots 46 of fixtures 32 until the folded edges of bags 12 extending around the free edges of plates 90 are positioned adjacent to bottom plates 40 of fixtures 32 when plates 90 are in their extended positions. Bottoms 16 of the lower third portions of bags 12 abut with support plates 42 of fixtures 32 and the side edges of bottoms 16 of the middle third portions of bags 12 abut with abutments 44. Slots 46 of fixtures 32 have a width generally equal to but slightly larger than the combined thickness of bag 12 folded over itself and of plates 90. Additionally, as previously set forth, the widths of plates 90 are less than the spacing between abutments 44 of fixtures 32. It should then be noted that the side fold edges of bag 12 and the folds of bags 12 about the free ends of plates 90 are not tightly creased by fixtures 32 and plates 90.

Plates 90 are then slid from their extended positions to their retracted positions by sliding blocks 92 on shafts 94 to withdraw plates 90 from slots 46 of fixtures 32, from between legs 84 and guides 86, and from bags 12 to their retracted positions.

To insure that bags 12 do not slide with plates 90 from fixtures 32, a catch mechanism 102 can be provided to engage bags 12 for allowing movement of bags 12 in a direction into fixtures 32 but preventing movement of bags 12 in a direction out of fixtures 32 with plates 90. Mechanism 102 generally includes first and second tubes 204 secured to frame 60 and located on opposite sides of plates 90. A shaft 206 is rotatably mounted inside of each of tubes 204 about an axis generally parallel to the movement direction of plates 90, with shaft 206 including opposite ends extending beyond the opposite ends of tubes 204. The inner end of each shaft 206 includes a compression roller 208 rotatable about an axis extending generally perpendicular to shaft 206. In the most preferred form, roller 208 is rotatable in only one direction about its axis and is unable to rotate about its axis in the opposite direction. Rotation of shaft 206 in tube 204 moves roller 208 from a first position generally engaging horizontal leg 84 and a second position generally spaced from horizontal leg 84. In the most preferred form, shaft 206 is biased from the first position to the second position by a spring 210 extending from frame 60 to a pin 212 extending perpendicular to shaft 206 in the opposite diametric direction than the axis of roller 208. For rotating shaft 206 against the bias of spring 210, a cam 214 is secured to mount bar 91 for each shaft 206. A cam follower 216 is rotatably mounted to the outer end of each shaft 206 about an axis generally perpendicular to shaft 206 and the axis of roller 208. Cams 214 move shaft 206 and rollers 208 between their second positions to their first positions just as plates 90 enter and leave the extended positions. Thus, rollers 208 briefly sandwich the opposite edges of bags 12 against horizontal leg 84 and outward of plates 90. In the most preferred form, rollers 208 rotate to roll on bags 12 as plates 90 move in the direction from their retracted positions to their extended positions but are not able to rotate or roll on bags 12 as plates 90 move in the direction from their extended positions to their retracted positions. Thus, rollers 208 hold bags 12 from initially moving with plates 90 as plates 90 move from their extended positions to their retracted positions. The sandwiching of the edges of bags 12 and the inability of rollers 208 to rotate and roll on bags 12 during the retraction of plates 90 hold bags 12 from moving with plates 90 as they initially move, with bags 12 typically not retracting from fixtures 32 with plates 90 with the release of rollers 208 after plates 90 are already in motion. In the most preferred form, compression of the edges of bag 12 is limited and minimized to a small length thereof by rollers 208. Although mechanism 102 is shown in the most preferred form, other methods of keeping bags 12 from sliding from fixtures 32 with plates 90 can be utilized including but not limited to ratchet-type catches which allow entry but prevent movement in the opposite direction.

After plates 90 have been retracted from fixtures 32, chains 24 can be advanced to move carrier bars 30 from the vertical portions of the parallelogram shape of the closed loop, with the advancement of fixtures 32 pulling any remaining portions of bags 12 still positioned between legs 84 and guides 86.

Stationary guides 274 are attached to frame 60 to prevent bags 12 from moving from slots 46 of fixtures 32 under centrifugal forces as fixtures 32 move around sprocket 27 moving from the vertical portion to the horizontal portion of the parallelogram shape of the closed loops of roller chains 24. Guides 274 include a first arcuate portion 276 which abuts with open ends 22 of bags 12 as they move around portions of the closed loops wherein change of direction from generally vertical to generally horizontal occurs. Guides 274 terminate in vertical stops 278 which abut with bottoms 16 adjacent ends 22 when fixtures 32 stop at the first intermittent position in the horizontal portion of the closed loops of roller chains 24.

As bars 30 intermittently advance in the operation direction along the horizontal portion of the closed loops of roller chains 24, bags 12 can be filled with a variety of material such as popcorn kernels and grease in the most preferred form. Where it is necessary to hold open ends 22 of bags 12 to allow filling, apparatus 10 includes first suction cups 104 associated with each bag 12 for removable securement to top 14 above fixtures 32 and second suction cups 106 for removable securement to bottom 16.

In the most preferred form, suction cups 104 are mounted to an elongated bar in the form of an angle iron 108 extending behind fixtures 32 and in a direction perpendicular to the operation direction of fixtures 32 and parallel to tops 14 of bags 12 held therein. First and second pivot arms 110 are pivotally mounted to frame 60 on opposite sides of apparatus 10 about an axis perpendicular to the operation direction of fixtures 32. Posts 112 upstand from pivot arms 110, with the ends of angle iron 108 slideably mounted to posts 112. Thus, angle iron 108 can be slid on posts 112 in a direction perpendicular to the operation direction and to angle iron 108 between an upper, transport position located above and spaced from fixtures 32 and bags 12 allowing fixtures 32 and bags 12 to pass underneath during movement of carrier bars 30 along the horizontal position of the closed loops of roller chains 24 and a lower, attachment position located above fixtures 32 with suction cups 104 positioned below ends 22 of bags 12 and adjacent to tops 14. By pivoting arms 110 when carrier bars 30 have stopped in their intermittent positions and with angle iron 108 in its lower position, angle iron 108 and suction cups 104 mounted thereon can be moved towards fixtures 32 and bags 12 until suction cups 104 engage and become attached to tops 14 of bags 12 for holding tops 14 in a generally linear position from slots 46 of fixtures 32. In the most preferred form, two suction cups 104 are provided to engage top 14 of each bag 12 at generally horizontally offset positions. Additionally, an abutment 105 is carried by angle iron 108 intermittent the two suction cups 104 for abutting with top 14 of bag 12 horizontally intermediate suction cups 104.

In the most preferred form, suction cups 106 are mounted to the lower ends of vertically extending rods 114 extending in a direction generally parallel to bottoms 16 of bags 12 held in fixtures 32. The upper ends of rods 114 are mounted to a slide shaft 116. Slide shaft 116 is horizontally slideably movable in a direction perpendicular to the operation direction of fixtures 32 between an attachment position and a transport position. In the transport position, rods 114 and suction cups 106 are positioned intermediate the lanes of fixtures 32 as carrier bars 30 move along the horizontal portion of the closed loops of roller chains 24 and specifically are spaced from bottoms 16 in a direction perpendicular to the operation direction of fixtures 32 and outwardly of the side edges of bags 12. In the attachment position, rods 114 and suction cups 106 are positioned inwardly of the side edges of bags 12 and in the operation direction in front of bottoms 16 of bags 12 and fixtures 32. Shaft 116 is moved in an arc from the attachment position with suction cups 106 positioned coextensive with slots 46 of fixtures 32 and an open position with suction cups 106 spaced from the front of fixtures 32.

In the most preferred form, shaft 116 is moved in an arc in a plane extending parallel to the operation direction of fixtures 32 by a triangular-shaped crank arm 118 pivotably mounted by one corner to frame 60 about an axis. Shaft 116 is pivotally mounted to the upper corner of crank arm 118. Crank arm 118 is pivoted about the axis by an actuator 120 attached to the other corner of crank arm 118. Shaft 116 is prevented from rotating by a reference shaft 122 slideably mounted in crank arm 118 parallel to shaft 116. A connector arm 124 extends between and is secured to each of shafts 116 and 122 in a nonrotatable manner. Shaft 116 is slid in crank arm 118 by a crank arm 126 pivotally mounted by one corner about an axis extending generally perpendicular to the pivot axis of crank arm 118. A connector link 128 is pivotally connected between shaft 116 and an upper corner of crank arm 126. Crank arm 128 is pivoted by an actuator 130 attached to the other corner of crank arm 126.

In the most preferred form, two suction cups 106 are provided to engage bottom 16 at generally vertically offset positions. In the most preferred form, the upper suction cups 106 engage bags 12 above fixtures 32 generally in line with stop 105, with stop 105 providing abutment for the upper suction cups 106 for insuring securement to bottom 16. The lower suction cups 106 engage bags 12 generally at the upper extent of fixtures 32, with folding bar 48 providing abutment for the lower suction cups 106 for insuring securement to bottom 16.

In operation of apparatus 10 of the most preferred form, angle iron 108 is located in its upper position and rods 114 are located in their transport positions allowing movement of carrier bars 30 and bag holding fixtures 32 thereby. After carrier bars 30 and bag holding fixtures 32 have moved to the intermittent position, angle iron 108 is lowered to its lower position and pivot arms 110 are pivoted to attach suction cups 104 to tops 14. Simultaneously, rods 114 are moved horizontally and shaft 116 is pivoted to its attachment position to engage suction cups 106 to bottoms 16. After the application of a vacuum, suction cups 104 and 106 engage and hold bags 12 located in fixtures 32. Shaft 116 is then pivoted from its attachment position to its open position to rotate rods 114 to pull bottoms 16 of bags 12 outwardly. As top 14 of each bag 12 is held by suction cups 104, bottom 16 is separated from top 14, opening gusseted sides 18 and end 22.

To bias the separation of bottom 16 from the bottom gusset of sides 18 rather than top 14 from the top gusset of sides 18, first and second stationary fingers or pins 280 are provided to abut with the top gusset of sides 18 attached to top 14. In the most preferred form shown, pins 280 are vertically oriented, have circular cross sections, and have free ends which are positioned vertically above fixtures 32. Pins 280 are parallel and spaced slightly less than the width of bottom 16 generally parallel to and within the fold lines between the top gussets of sides 18 and top 14 and the fold lines between the bottom gussets of sides 18 and bottom 16, and are positioned to abut with bottom 16 below end 20 when bags 12 are completely collapsed and initially positioned in the intermittent position including the bag opening device. As bottom 16 is pulled when shaft 116 is rotated, bottom 16 deforms with the edges of bottom 16 deflecting around and passing pins 280, with the ease of passage of bottom 16 beyond pins 280 being enhanced when bottom 16 has a width less than top 14 in the most preferred form when bottom 16 passes pins 280, pins 280 then abut with the top gusset of sides 18 and hold or sandwich the top gusset of sides 18 against top 14. Top 14 does not pass pins 280 due to the connection of suction cups 104 and in the most preferred form due to its greater width than bottom 16. Abutment of the top gusset of sides 18 towards top 14 by pins 280 tends to unfold the bottom gussets of sides 18 from bottom 16 to increase the open area between the bottom gussets of sides 18 and bottom 16 for receipt of the product. Although pins 280 are shown in the most preferred form, other methods for biasing the separation of bottom 16 from the bottom gusset of sides 18 could be utilized in conjunction with or instead of pins 280 such as but not limited to air blast jets or nozzles, stops which tend to arcuately shape bottom 16 when attached to suction cups 106, or the like.

It should then be noted that the particular construction of fixtures 32 are advantageous in opening bags 12 in apparatus 10 according to the preferred teachings of the present invention. Particularly, abutments 44 generally hold bottom 16 by its side edges such that bottom 16 tends to naturally bulge outwardly and separate from top 14 and gusseted sides 18 in fixtures 32 without wrinkling. Additionally, the arcuate inside edges as well the arcuate portion at the interconnection of the legs of abutment 44 help define a pocket spaced from the edges and corners of bags 12 for receipt and capture of product, with such a pocket being advantageous in holding and containing the product in the final form. Material can then be fed into bags 12 through ends 22 held open by suction cups 104 and 106 into this bulge of bottom 16. This is especially advantageous for microwave popcorn popping bags 12 as it is desired to load the popcorn and oil adjacent to the susceptor pad located on bottom 16. Further, expansion prevention bars 49 limit the size of the pocket to prevent bags 12 from blossoming out between abutments 44 due to the introduction of the product and help to retain bags 12 from slipping out of fixtures 32 in the operation direction between abutments 44 especially when moving with chains 24 and when filled with product. Carrier bars 30 can be vibrated during filling or while moving between the intermittent positions in the filling stations of the closed loop of chains 24 for certain products to assure product settling in bags 12 before sealing.

One or more intermittent positions along the horizontal portions of the parallelogram shape of the closed loop can include the bag opening device having suction cups 104 and 106 depending upon the types of materials which bags 12 are formed and the product and number of fill locations necessary for that product. For example, the product itself may be sufficient to hold end 22 open after product is filled in bags 12 in the first or later fill positions such that later fill positions do not need or do not require devices for opening bags 12. To insure that bags 12 are being held open by the bag opening device, vacuum checks can be made on suction cups 104 and/or 106 to insure that securement to bags 12 has occurred. Fill positions which do not have bag opening devices can utilize a photo eye check or the like to insure that bags 12 are open before filling occurs.

In the case of microwave popcorn popping bags 12, popcorn kernels, grease or oil, or the like can be dispensed by a suitable dispenser 132 in a stream in front of bottom 16 and preferably intermediate the bottom gusset of sides 18 and bottom 16.

After the filling operation, the vacuum to suction cups 104 and 106 is shut off to release bags 12 held in fixtures 32. Pivot arms 110 can then be pivoted to move angle iron 108 and suction cups 104 away from tops 14 and angle iron 108 is raised to its transport position. Simultaneously, rods 114 are moved horizontally to their transport positions in the lanes between fixtures 32 of carrier bars 30. At that time, roller chains 24 can be moved to advance carrier bars 30 and bag holding fixtures 32 in the operation direction to the next intermittent position. It can then be appreciated that tops 14 and the top gussets of sides 18 are able to deform or deflect around pins 280 with movement of fixtures 32 from the filling position after release of vacuum to suction cups 104.

After bags 12 have been filled with the desired product such as popcorn kernels, grease or oil, or the like, bags 12 in fixtures 32 are advanced to the sealing positions, with two sealing positions being utilized in the most preferred form. In the most preferred form, as the product in bag 12 will tend to hold end 22 open and top 14 and bottom 16 at a non-parallel angle to each other, bags 12 are collapsed and air is forced therefrom prior to the first sealing operation. Particularly, an elongated abutment rod 282 is horizontally positioned across apparatus 10 at a height slightly above the height of fixtures 32 at a distance less than the spacing of end 22 from fixtures 32 and at a spacing in front of the first sealing intermittent position generally equal to but slightly more than the height or spacing of bags 12 above fixtures 32. A flat plate stop 284 is horizontally positioned across apparatus 10 at a height to abut with bag 12 adjacent to end 22. Stop 284 is positioned to be coextensive with slots 46 of fixtures 32 in the first sealing intermittent position. In operation and while the fixtures 32 are moving from the intermittent position just prior to the first sealing intermittent position, bottoms 16 of bags 12 engage with rods 282. Further movement of fixtures 32 and bags 12 held therein causes tops 14 to continue to move forward while bottoms 16 are held stationary by rods 282 until bottoms 16 deflect into a generally collapsed position against tops 14. Further movement of fixtures 32 and bags 12 held therein causes the portions of bags 12 above fixtures 32 with bottoms 16 collapsed against top 14 to further deflect rearwardly in a direction opposite to the operation direction generally about folding bar 48 due to the abutment of bottoms 16 with rod 282. Further movement of fixtures 32 and bags 12 held therein toward the first sealing intermittent position causes end 22 to pass rod 282 with bottom 16 no longer being abutted, the portions of bags 12 above fixtures 32 will return to a linear condition with the portions of bags 12 within fixtures 32 due to the memory of the material forming bags 12. Stop 284 abuts with bottoms 16 just as fixtures 32 reach the first sealing intermittent position and the upper portions of bags 12 reach their linear condition with the portions of bags 12 within fixtures 32. Due to the slapping action of the portions of bags 12 above fixtures 32 moving from the bent to linear positions against stop 284 while fixtures 32 are still moving, tops 14 and bottoms 16 will be in a collapsed condition when abutting with stop 284.

Further, generally J-shaped arms 136 are positioned on opposite sides of apparatus 10 and each include a first leg and a second leg. A rod 138 extends between the free ends of the second legs of arms 136. Arms 136 are pivotally mounted about a pivot axis in the form of a shaft 142 extending generally parallel to rod 138 and adjacent to and extending between the first legs of arms 136, with axis 142 extending generally perpendicular to the operation direction of fixtures 32 and spaced in the operation direction behind fixtures 32 and tops 14 and bottoms 16 of bags 12 in the first sealing intermittent position and spaced above bags 12 allowing fixtures 32 and bags 12 held therein to move in a non-abutting position therewith. Arms 136 are pivoted between a transport position and a compressing position. In the transport position, rod 138 is located above fixtures 32 and bags 12 held therein allowing carrier bars 30 and fixtures 32 mounted thereto to move under rod 138. When pivoted from its transport position, rod 138 travels along an arc to its compressing position and engages with bottoms 16 at a vertical location intermediate the vertical extent of fixtures 32 and sandwiches bottom 16 against sides 18 and top 14 and in the most preferred form above bars 49 of fixtures 32. It should then be noted that rod 138 deflects the product located within the bulges of bags 12 to a more planar condition to reduce the overall height between tops 14 and bottoms 16 of bags 12 in their final commercial form.

With bags 12 sandwiched between rod 138 and fixtures 32 and abutting with stop 284, first and second heat sealing jaws 144 and 146 are lowered and clamp bags 12 adjacent end 22 for sealing end 22. In the preferred form, stop 284 is mounted to and carried with jaw 146 and slides downwardly on bottoms 16 towards fixtures 32 when jaws 144 and 146 are lowered to their sealing position. Further, in the most preferred form, jaws 144 are biased by springs 148. It can then be appreciated that suitable sensors can be provided to detect if end 22 has been properly sealed. After sealing, jaws 144 and 146 are separated and positioned above bags 12, and arms 136 are pivoted from the compressing position to the transport position. Then, carrier bars 30 and fixtures 32 mounted thereon and bags 12 held therein are moved to the next, intermittent sealing position where first and second heat sealing, silicone foam covered Jaws 150 and 152 clamp bags 12 adjacent end 22 for again sealing end 22. In the most preferred form, jaws 152 are biased by springs 154. After sealing in the second, intermittent sealing position, jaws 150 and 152 are separated and positioned above bags 12. Then, carrier bars 30 and fixtures 32 mounted thereon and bags 12 held therein are moved to the next, intermittent position in the preferred form.

Apparatus 10 further includes a device 170 for ejecting bags 12 from fixtures 32, with device 170 ejecting marketable bags 12 from one intermittent position of fixtures 32 and ejecting defective bags 12 from the next intermittent position of fixtures 32. Specifically, in the most preferred form, device 170 includes first and second pushing plates 172 and 174 arranged in spaced, parallel relations. Pushing plates 172 and 174 have widths for slideable receipt in apertures 37 of carrier bars 30 between halves 34 of fixtures 32, with plates 172 extending through apertures 37 of carrier bar 30 in the intermittent position Just prior to the intermittent position that plates 174 extend through apertures 37 of carrier bar 30. Plates 172 and 174 are generally horizontally movable between a retracted position and an extended position. Specifically, in the most preferred form, plates 174 are secured to a mount bar 175 in laterally spaced positions corresponding to fixtures 32 on carrier bars 30. Mount bar 175 is longitudinally movably mounted by first and second slide blocks which are slideably mounted on support shafts 178. In the most preferred form, a rack gear 180 secured to mount bar 175 intermediate the slide blocks is moved by rotation of a gear 182 to slide the slide blocks on shafts 178 to longitudinally move mount bar 175 and plates 174 between their retracted and extended positions. In the most preferred form, plates 172 are slideably mounted to frame 60 and individually, releasably secured to mount bar 175 such as by the use of an air cylinder 177. Additionally, plates 172 are individually releasably secured to frame 60 such as by the use of an air cylinder 179. In the preferred form, air cylinders 177 and 179 extend and retract a pin from an aperture formed in plates 172. In operation, after fixtures 32 have moved to the first intermittent position in ejecting device 170 and with air cylinders 177 securing plates 172 to mount bar 175 and air cylinders 179 being released from plates 172, plates 172 and 174 are moved from their retracted positions to their extended positions to push bags 12 from fixtures 32. However, if a bag 12 has been previously detected as being defective, the securement of plate 172 to mount bar 175 by air cylinder 177 is released and air cylinder 179 secures plate 172 to frame 60 for that particular lane such that plate 172 does not move with mount bar 175 and plate 174. Fixtures 32 are then moved to their next intermittent position. It can then be appreciated that any bags 12 remaining in fixtures 32 will be pushed therefrom by plates 174 in the next movement of plates 172 and 174, with plates 172 ejecting the marketable bags 12 from the next fixtures 32 in the continuous loops of chains 24 and plates 174 ejecting any defective bags 12 remaining in fixtures 32 or simply sliding through fixtures 32 if marketable bags 12 had been previously ejected therefrom. The free ends of plates 172 and 174 may include a concave surface or compressible material so that they do not slide beyond the end of bags 12 in fixtures 32.

Stationary guides 184 are attached to frame 60 to prevent bags 12 from moving from slots 46 of fixtures 32 under centrifugal forces as fixtures 32 move around sprocket 28 moving from the horizontal portion to the generally vertical portion of the parallelogram shape of the closed loops of chains 24. The inlets of guides 184 are spaced from fixtures 32 to an extent equal to that of the portions of bags 12 extending beyond fixtures 32. Apparatus 10 according to the preferred teachings of the present invention includes suitable provisions for folding bags 12 into three generally equal portions in their commercialized form. In the most preferred form, guides 184 are configured and positioned in frame 60 adjacent to the closed loops of roller chains 24 to fold the portions of bags 12 extending beyond fixtures 32 about folding bar 48 of fixtures 32 as carrier bar 30 moves in guides 184 and into the intermittent position that plates 172 eject marketable bags 12 from fixtures 32. In the most preferred form, guides 184 hold the portions of bags 12 extending beyond fixtures 32 generally perpendicular to the portions of bags 12 located within fixtures 32 and to slots 46 of fixtures 32 when carrier bar 30 is located in the intermittent position that plates 172 eject marketable bags 12 from fixtures 32 and prior to bags 12 being ejected from fixtures 32.

Bags 12 are pushed from fixtures 32 by plates 172 into pockets 186, with bags 12 being folded and held in a planar form of three generally equal portions as bags 12 are pushed into pockets 186. In the most preferred form, each of the pockets 186 is formed by a first generally closed bottom 188, a top 190 formed by first and second plates arranged parallel to and spaced from bottom 188 and spaced from each other, first and second sides 192 extending perpendicular between bottom 188 and top 190, a first open end 194, and a second end 196 formed by first and second plates extending perpendicularly between bottom 188 and top 190 and perpendicular to sides 192 and spaced from each other the same distance that the plates forming top 190 are spaced. In the most preferred form, top 190, sides 192, and end 196 are formed integrally together.

As plates 174 eject bags 12 from fixtures 32, movement of bags 12 out of fixtures 32 causes the upper portions of bags 12 initially folded about the fold created by folding bar 48 to continue to fold from a perpendicular angle to an angle smaller than 90° to a position generally parallel to lower and central portions of bags 12 and sandwiching the lower portion between the upper portions and the central portions. Prior to ends 22 of bags 12 being pushed from beneath guides 184, the leading edges of folded bags 12 which would be the fold between the upper and central portions of bags 12 extend through open end 194 and into pockets 186, with bottom 188 and top 190 being generally parallel to and in line with slots 46 and being spaced a distance generally equal to and for slideable receipt of bags 12 in their commercialized form. When plates 172 push bags 12 from fixtures 32, plates 172 push bags 12 into pockets 186 and generally within open end 194 of pockets 186.

In the preferred form, pockets 186 have a first, bag receiving position and a second, inverted position. In the most preferred form, each lane of apparatus 10 includes first and second pockets 186 positioned on opposite sides of a shaft 198 rotatable in frame 60 about a horizontal axis. Specifically, bottoms 188, tops 190, and ends 194 and 196 are located on opposite sides of shaft 198 with tops 190 located radially outwardly of bottoms 188 from shaft 198. In the first, bag-receiving position, pockets 186 are aligned with fixtures 32 in the intermittent position that plates 172 eject marketable bags 12 from fixtures 32. In the second, inverted position, pockets 186 are located below pockets 186 in their first, bag-receiving position with tops 190 located below bottoms 188 and with open end 194 being located on the opposite side of end 196 than fixtures 32.

Apparatus 10 further includes a device 200 for transporting bags 12 from pockets 186 to further processing stations such as wrapping, packaging and the like, with two laterally extending conveyors 200 moving in opposite directions to opposite sides of apparatus 10 being provided in the most preferred form, with each conveyor 200 receiving bags 12 from the two lanes of apparatus 10 adjacent the side of delivery. Apparatus 10 further includes provisions for removing bags 12 from pockets 186 in their second, inverted position and placing bags 12 on conveyors 200. In the preferred form, a carriage 218 is slideably mounted on longitudinally extending support shafts 220 between a first inner position and a second outer position. Carriage 218 includes a plurality of uprights 222 located intermediate the lanes of fixtures 32. Pivotally mounted to the upper ends of uprights 222 are arms 224. The free ends of arms 224 are secured to a laterally extending bar 226. Support lands 228 are secured to bar 226 corresponding to the lanes of apparatus 10 and particularly pockets 186 thereof and have a width corresponding to the width of bags 12. Each land 228 includes an upright lug 230 extending therefrom and having a width and positioned for slideable receipt between the plates forming top 190 of pockets 186. In the most preferred form, arms 224 and bar 226 are pivoted by extensions 232 formed on the two outer arms 224 extending on the opposite side of uprights 222 than bar 226, with extensions 232 having cams 234 slideably received in cam tracks 236 attached to frame 60.

In operation, after bags 12 have been inserted into pockets 186 in their first, bag-receiving position by plates 172, pockets 186 are rotated by shaft 198 to their second inverted position. It should be noted that when pockets 186 are rotated, carriage 218 is located in its first inner position and arms 224 and bar 226 are pivoted by cams 234 and cam tracks 236 such that lands 228 are in a non-interferring relation with rotation of pockets 186 about shaft 198. Additionally, it can be appreciated that when pockets 186 including bags 12 are rotated from their first, bag-receiving position to their second, inverted position, pockets 186 on the opposite diametric side of shaft 198 (which do not include bags 12) are simultaneously rotated from their second, inverted position to their first, bag-receiving position. At that time, carriage 218 moves from its first, inner position to its second, outer position with movement of carriage 218, arms 224 and bar 226 are pivoted by cams 234 and cam tracks 236 such that lands 228 are located below and generally parallel to top 190. With further movement of carriage 218, lugs 230 of lands 228 pass between the plates forming end 196 and top 190 and engage bags 12 located in pockets 186 in their second, inverted position. With further movement of carriage 218, lugs 230 push bags 12 located in pockets 186 onto lands 228 for movement thereon. When carriage 218 is located in its second, outer position, bags 12 and lands 228 are positioned over conveyors 200.

With bags 12 positioned over conveyors 200, carriage 218 is moved from its second, outer position to its first, inner position. To remove bags 12 from lands 228 and prevent bags 12 from riding back with lands 228, device 286 is provided including a carriage 288 vertically reciprocally mounted such as on shafts 290 by linear bearings. Carriage 288 is reciprocated by suitable means such as by an arm 292 pivotally connected thereto and reciprocated by suitable means such as a crank arm, cam assembly, or the like, not shown. Device 286 further includes fingers 294 pivotally mounted by their upper ends to carriage 288, with one finger 294 provided for each lane of apparatus 10 in the preferred form. In the most preferred form, fingers 294 are secured to a mounting plate 296 in turn pivotally mounted to carriage 288 by ears 298 extending therefrom. Cams 300 are mounted to mounting plate 296 which engage stationary rotatable cam followers 302 mounted to frame 60. Mounting plate 296 is biased inwardly by springs 304 extending between carriage 288 and mounting plate 296.

In operation, carriage 288 is located in its vertically upper position, with cams 300 spaced from cam follower 302 and mounting plate 296 and fingers 294 secured thereto biased in their inner position by springs 304. When bags 12 and lands 228 are positioned over conveyors 200, carriage 288 slides on shafts 290 vertically downwardly to lower fingers 294 such that the lower ends thereof are positioned behind bags 12 and above lands 228. Additionally, prior to reaching the vertically lower position of carriage 288, cams 300 engage with cam followers 302 to pivot fingers 294 from their inner positions to their outer positions against the bias of springs 304 to push bags 12 outwardly of lands 228 and onto conveyor 200. It can be appreciated that once fingers 294 are positioned behind bags 12, lands 228 can be moved from the outer positions to the inner positions, with the abutment of bags 12 with fingers 294 preventing bags 12 from riding back with lands 228. With bags 12 removed from lands 228 and positioned on conveyors 200, carriage 288 can be moved from its lower position to its upper position. It can be appreciated that as carriage 288 moves vertically upwardly, cams 300 will ride up on followers 302 and allow springs 304 to pivot fingers 294 relative to carriage 288 from their outer positions to their inner positions. It can then be appreciated that the motion of carriage 288 in a single, vertical direction along shafts 290 results in motion of fingers 294 in both vertical and horizontal directions, which is advantageous in reducing the complexity of the drive and the energy requirements.

Brackets 238 are pivotally mounted to conveyor 200 having free ends, with bags 12 being able to slide onto conveyor 200 by lands 228 and device 286 under brackets 238 in a first direction. To prevent bags 12 from unfolding on conveyor 200 after its removal from pockets 186 by lands 228 due to any tendency of bags 12 to pivot about their folds to a linear condition, lateral slide bars 240 are secured to brackets 238 for resting upon and slideably abutting with the central portion of bags 12 as bags 12 are being conveyed by conveyors 200. In the most preferred form, the placement of the pivots of brackets 238 prevents brackets 238 and thus slide bars 240 from pivoting toward conveyors 200 beyond a generally parallel position thereto to prevent excessive force from being placed upon bags 12 by brackets 238 and slide bars 240 while allowing brackets 238 to pivot away from conveyors 200 for ease of access to conveyors 200.

After ejecting device 170, carrier bars 30 and fixtures 32 move in intermittent positions along the horizontal portion of the parallelogram shape of the closed loops of chains 24 back to loading device 50 for again loading bags 12 into fixtures 32.

It should be appreciated that various overload protection devices can be utilized to stop operation of apparatus 10 or a particular station thereof in the event of a jam or other interruption in the loading, opening, filling, collapsing, sealing, folding, ejection, and/or removal operation.

Now that the basic construction and operation of apparatus 10 according to the preferred teachings of the present invention have been explained, many extentions and variations may be obvious to a person skilled in the art. For example, although fixtures 32 have been shown and described as being formed of nonmovable parts, fixtures 32 can be of a hinged type which include legs which are openable and closeable. For example, the legs could be biased by springs to a normally closed position and can be cammed open against the bias of the springs. vacuum suction cups could be provided to the legs of the fixtures to attach to the bag surfaces for opening with bags when the legs are hinged open, with the suction cups being continuously under vacuum or intermittently under vacuum only in the task positions where opening of the bag is desired. The legs of fixtures 32 can be shaped to correspond to the filled shape of bags 12.

Likewise, fixtures 32 could include a spring or like clamping member which sandwiches bags 12 in fixtures 32 to prevent bags 12 from slipping out of fixtures 32 during movement of fixtures 32 about the parallelogram shape of the closed loops of chains 24. Suitable apparatus such as suction cups may be necessary to pull back such spring or clamping member during filling or removal operations.

Further, although bags 12 have been described having a closed end 20 in the most preferred form, tubes can be provided with ends 20 being closed by a suitable sealing device associated with or adjacent to bottom stop 72. Similarly, bags 12 having side edges which are not sealed can be provided which are sealed prior to or at the time of loading into fixtures 32.

Although bags 12 have been described in the most preferred form as microwave popcorn popping bags 12 and specifically are folded into a central portion having first and-second wing portions and in the most preferred form into thirds, bags 12 could be loaded into fixtures 32 in an unfolded condition and not be folded in ejecting device 170 where bags 12 are not desired to be folded in the final form. Similarly, bags 12 could be filled with other types of product than popcorn kernels such as but not limited to baking ingredients such as cake mixes, sauces such as catsup, and the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Fixture for receipt of a bag including a top, a bottom, first and second side edges, a sealed lower end, and an unsealed upper end, comprising, in combination:

first and second fixture halves, with each of the fixture halves including a side plate and a bottom plate extending generally perpendicular to the side plate, a support plate of a rectangular configuration extending generally perpendicular to the side plate and to the bottom plate, and an L-shaped abutment having a first leg extending generally perpendicular to the side plate for abutting with the side edges of the bag and a second leg extending generally perpendicular to the bottom plate, with the support plate being spaced from the L-shaped abutment to define a slot therebetween for slideable receipt of the side edges of the bag; and means for holding the first and second fixture halves in a spaced relation, with the bottom being deformable outward between the abutments of the first and second fixture halves with the first and second side edges abutting with the abutments.

2. The fixture of claim 1 further comprising, in combination:

a bar extending between the side plates of the first and second fixture halves above and generally at the same extent as the support plates of the first and second fixture halves.

3. The fixture of claim 2 wherein the slot has a width at least equal to twice the thickness of the bag between the top and bottom, with the bag being folded about a fold line with a first portion of the bag having the top overlying the top of a second portion of the bag, with the fold line abutting with the bottom plates of the first and second fixture halves, with the bottom of the first portion abutting with the support plates and with the side edges of the second portion abutting with the L-shaped abutments.

4. The fixture of claim 3 wherein the legs of the L-shaped abutments have arcuate inside edges.

5. The fixture of claim 4 further comprising, in combination: a bar extending between the first legs of the L-shaped abutments of the first and second fixtures halves spaced above the bottom plates.

6. The fixture of claim 1 wherein the slot has a width at least equal to twice the thickness of the bag between the top and bottom, with the bag being folded about a fold line with a first portion of the bag having the top overlying the top of a second portion of the bag, with the fold line abutting with the bottom plates of the first and second fixture halves, with the bottom of the first portion abutting with the support plates and with the side edges of the second portion abutting with the L-shaped abutments.

7. The fixture of claim 1 wherein the legs of the L-shaped abutments have arcuate inside edges.

8. The fixture of claim 1 further comprising, in combination:

a bar extending between the first legs of the L-shaped abutments of the first and second fixtures halves spaced above the bottom plates.

9. Apparatus for filling a bag having an unsealed end, a top, and a bottom comprising, in combination:

a fixture for receipt of the bag; means for moving the fixture at intermittent positions in an operation direction along a closed loop shape having a first, generally vertical portion terminating in a second, generally horizontal portion in turn terminating in a third, generally vertical portion terminating in a fourth portion in turn terminating in the first portion; means for loading the bag into the fixture in the first portion; means for filling the bag loaded in the fixture in the second portion; means for sealing the bag loaded in the fixture in the second portion; and means for ejecting the bag from the fixture in the third portion.

10. The apparatus of claim 9 wherein the bag includes first and second side edges; and wherein the fixture comprises, in combination:

first and second fixture halves, with each of the fixture halves including a side plate and a bottom plate extending generally perpendicular to the side plate, a support plate of a rectangular configuration extending generally perpendicular to the side plate and to the bottom plate, and an L-shaped abutment having a first leg extending generally perpendicular to the side plate for abutting with the side edges of the bag and a second leg extending generally perpendicular to the bottom plate, with the support plate being spaced from the L-shaped abutment to define a slot therebetween for slideable receipt of the side edges of the bag; and means for holding the first and second fixture halves in a spaced relation, with the bottom being deformable outward between the abutments of the first and second fixture halves with the first and second side edges abutting with the abutments.

11. The apparatus of claim 10 wherein the slot has a width at least equal to twice the thickness of the bag between the top and bottom, with the bag being folded about a fold line with a first portion of the bag having the top overlying the top of a second portion of the bag, with the fold line abutting with the bottom plates of the first and second fixture halves, with the bottom of the first portion abutting with the support plates and with the side edges of the second portion abutting with the L-shaped abutments.

12. The apparatus of claim 10 wherein the legs of the L-shaped abutments have arcuate inside edges.

13. The apparatus of claim 9 wherein the means for loading the bag into the fixture comprises a tucking plate movable between a retracted position and an extended position, with the fixture having a slot formed therein, with the tucking plate insertable in the slot of the fixture for driving the bag into the slot of the fixture when the tucking plate moves from the retracted position to the extended position.

14. The apparatus of claim 13 wherein the means for loading the bag into the fixture further comprises, in combination:

means for preventing movement of the bag with the tucking plate as the tucking plate moves from the extended position to the retracted position.

15. The apparatus of claim 14 further comprising, in combination:

a leg extending generally parallel to the slot of the fixture; wherein the bag has first and second side edges, with the width between the first and second side edges of the bag being larger than the width of the tucking plate; and wherein the preventing means comprises means for sandwiching at least one of the first and second side edges against the leg.

16. The apparatus of claim 13 wherein the bag has a sealed end, with the bag being positioned generally perpendicular to the slot of the fixture with the slot of the fixture located intermediate the sealed and unsealed ends of the bag, with the tucking plate insertable in the slot of the fixture for driving the bag into the slot of the fixture and creating a fold in the bag when the tucking plate moves from the retracted position to the extended position with the bag having a U-shaped configuration around the tucking plate.

17. The apparatus of claim 13 further comprising, in combination:

a support extending generally parallel to the slot of the fixture; a block slideably mounted to the support, with the tucking plate mounted to the block; and means for sliding the block on the support for inserting the tucking plate into the slot of the fixture.

18. The apparatus of claim 17 wherein the sliding means comprises, in combination:

a rack gear secured to the block; and a rotatable gear in gearing relation with the rack gear.

19. The apparatus of claim 9 wherein the bag comprises first and second side edges; and wherein the means for loading the bag into the fixture includes first and second nip rollers, with the nip rollers each having at least first wheels which abut and roll on each other for engaging the bag intermediate the side edges.

20. The apparatus of claim 19 wherein the bag includes first and second gusseted sides having inner folds, with each of the nip rollers including second and third wheels, with the first wheel engaging the bag intermediate the inner folds of the first and second gusseted sides, with the second wheel engaging the bag intermediate the inner fold of the first gusseted side and the first side edge, and with the third wheel engaging the bag intermediate the inner fold of the second gusseted side and the second side edge.

21. The apparatus of claim 9 further comprising, in combination:

means for removing the front bag from a supply of bags held in a magazine, with the bags having sealed ends spaced horizontally outward from the unsealed ends of the bags in the magazine comprising a linkage assembly comprising, in combination:

a first, C-shaped linkage having a lower end and an upper end, with the first, C-shaped linkage being pivotally mounted about an axis intermediate the lower and upper ends; a second linkage having a first end and a second end, with the first end of the second linkage being pivotally mounted to the upper end of the first, C-shaped linkage; a third linkage having a first end and a second end, with the first end of the third linkage being pivotally mounted to the second end of the second linkage; a fourth linkage having an upper end and a lower end, with the lower end of the fourth linkage being pivotally mounted to the lower end of the first linkage, with the upper end of the fourth linkage being pivotally mounted to the second end of the third linkage; means carried by the third linkage for releasably attaching to the front bag; and means for pivoting the first, second, third and fourth linkages relative to each other between a first position with the releasably attaching means engaging with the front bag held in the magazine and a second position with the front bag in a generally vertical condition in front of the magazine.

22. The apparatus of claim 9 further comprising, in combination:

means for preventing the bag from moving from the fixture under centrifugal forces as the fixture moves between the vertical and horizontal portions.

23. The apparatus of claim 22 wherein the preventing means comprises a stationary guide which abuts with the unsealed end of the bag loaded in the fixture.

24. The apparatus of claim 23 wherein the bag includes a portion located in the fixture and a portion extending beyond the fixture, with the guide positioned between the second and third portions of the closed loop shape, with the guide holding the portion of the bag extending beyond the fixture at a nonlinear angle to the portion of the bag located in the fixture before the bag is ejected from the fixture by the bag ejecting means.

25. The apparatus of claim 23 wherein the unsealed end is spaced from the fixture, with the guide positioned between the first and second portions of the closed loop shape, with the guide terminating in a vertical stop which abuts with the bottom of the bag adjacent the unsealed end at the first intermittent position in the second portion of the closed loop shape.

26. The apparatus of claim 9 wherein the bag has first and second gusseted sides, with each gusseted side including at least a top gusset and a bottom gusset, with the top gusset being pivotally connected to the top about a fold line and the bottom gusset being pivotally connected to the bottom about a fold line; and wherein the filling means includes means for biasing the separation of the bottom from the bottom gussets rather than the top from the top gussets.

27. The apparatus of claim 26 wherein the biasing means comprises, in combination:

first and second pins in a spaced, parallel relation and generally parallel to and within the fold lines of the top gussets and the top, with the pins engaging the bag below the unsealed end, with the bottom deforming around the pins as the bottom moves to an open position relative to the top with the first and second pins engaging the top gussets and sandwiching them against the top.

28. The apparatus of claim 9 wherein the bag has a side edge; and wherein the filling means comprises, in combination:

means for removable securement to the bottom; a rod extending in a direction generally parallel to the bottom of the bag; means for moving the rod from a transport position located spaced from the bottom in a direction perpendicular to the operation direction and outwardly of the side edge of the bag to an attachment position located inwardly of the side edge of the bag and in the operation direction in front of the bottom of the bag, with the removable securement means being attached to the rod.

29. The apparatus of claim 9 wherein the filling means comprises, in combination:

means for removable securement the top; an elongated bar extending in a direction perpendicular to the operation direction and parallel to the top, with the removable securement means mounted to the bar; and means for moving the elongated bar in a direction perpendicular to the operation direction and the elongated bar between a transport position and an attachment position, with the elongated bar and the removable securement means being spaced from the bag in the transport position.

30. The apparatus of claim 9 wherein the fixture includes means for supporting the top spaced from the unsealed end, with the fixture and the bag held therein being movable in the operation direction generally perpendicular to the top and bottom and stopping at an intermittent position in the second portion of the closed loop shape, with the unsealed end being open and the top and bottom extending at a non-parallel angle to each other, with the unsealed end being at a spacing from the fixture; and wherein the sealing means comprises, in combination:

an abutment positioned above the fixture moving in the operation direction at a distance less than the spacing and in front of the intermittent position at a distance from the fixture generally equal to but slightly larger than the spacing, with the abutment deflecting the bottom and top above the fixture in a direction opposite to the operation direction as the fixture moves in the operation direction past the abutment; and a stop positioned at the intermittent position and at a height to abut with the bag adjacent to the unsealed end, with the portions of the bag above the fixture returning to an undeflected condition after the unsealed end passes the abutment and the unsealed end slapping against the stop as the fixture reaches the intermittent position.

31. The apparatus of claim 30 further comprising, in combination:

at least a first arm; means for pivoting the arm about an axis extending generally perpendicular to the operation direction in the second portion of the closed loop shape; and a rod extending from the first arm parallel to and spaced from the arm axis, with the first arm being pivotal between a transport position and a compressing position, with the rod in the transport position spaced from the fixture and the bag allowing the fixture and the bag to move in the second portion of the closed loop shape in the operation direction without abutment, with the rod engaging the bottom of the bag when the first arm moves from the transport position towards the compressing position, with the bag sandwiched between the top supporting means and the rod when the first arm is in the compressing position.

32. The apparatus of claim 9 wherein the fixture is movable in the third portion of the closed loop shape in the operational direction from a first position to a second position; and wherein the ejecting means comprises, in combination:

a first pushing plate; a second pushing plate; means for moving the second pushing plate between a retracted position and an extended position, with the second pushing plate ejecting bags from the fixture in the second position when moved from the retracted position to the extended position; and means for releasably securing the first pushing plate to the second pushing plate for movement with the second pushing plate, with the first pushing plate ejecting bags from the fixture in the first position when the second pushing plate is moved from the retracted position to the extended position.

33. The apparatus of claim 9 wherein the ejecting means comprises, in combination:

a pushing plate; means for moving the pushing plate in a movement direction between a retracted position and an extended position, with the pushing plate ejecting bags from the fixture when the pushing plate moves from the retracted position to the extended position; and a pocket located in line with the movement direction of the pushing plate from the fixture, with the pocket being of a size for slideable receipt of the bag, with the pocket slideably receiving the bag when the bag is ejected from the fixture by the pushing plate.

34. The apparatus of claim 33 further comprising, in combination:

means for moving the pocket from a first position to a second, inverted position, with the pocket receiving the bag from the fixture in the first position; and means for removing the bag from the pocket in the second, inverted position.

35. The apparatus of claim 34 wherein the moving means comprises means for rotating the pocket about an axis between the first and second positions.

36. The apparatus of claim 35 wherein the removing means comprises, in combination:

a land, with the land including a lug for abutting with the bag in the pocket; and means for moving the land in a movement direction between a first position and a second position, with the land in its first position being in a non-interferring position with the pocket and the rotation between the first and second positions of the pocket, with the lug pushing the bag from the pocket in the second, inverted position onto the land as the land moves from the first position to the second position, with the bag being removed from the pocket and supported by the land in the second position of the land.

37. The apparatus of claim 36 further comprising, in combination:

means for preventing the bag from riding back with the land as the land moves from the second position to the first position comprising, in combination:

a finger having a free end for engaging with the bag; and means for carrying the finger between a first position and a second position, with the free end of the finger being in a spaced condition from the bag and the land in the first position and with the free end of the finger abutting with the bag in the second position, with the finger being in the first position while the land and the bag moves from the first position to the second position and with the finger being in the second position while the land moves from the second position to the first position.

38. The apparatus of claim 10 wherein the moving means comprises, in combination: at least a first roller chain; and a carrier bar secured to the roller chain, with the holding means being removably secured to the carrier bar.

39. Device for moving a fixture at intermittent positions in an operation direction along a first portion terminating in a second portion extending generally perpendicular to the first portion, with the fixture receiving a bag, comprising, in combination:

means for preventing the bag from moving from the fixture under centrifugal forces as the fixture moves between the first and second portions comprising a stationary guide, with the fixture moving relative to the stationary guide, with the stationary guide abutting with the bag received in the fixture as the fixture moves relative to the stationary guide.

40. The apparatus of claim 39 wherein the bag includes a portion located in the fixture and a portion extending beyond the fixture, with the first portion being generally horizontal, with the guide holding the portion of the bag extending beyond the fixture at an angle other than 180° to the portion of the bag located in the fixture when the bag is located in the second portion.

41. The apparatus of claim 39 wherein the bag includes an unsealed end spaced from the fixture, with the first portion being vertical, with the guide terminating in a vertical stop which abuts with the bag adjacent the unsealed end and intermediate the unsealed end and the fixture at the first intermittent position in the second portion.

42. Method for moving a bag comprising the steps of:

providing a fixture for receiving the bag; moving the fixture at intermittent positions in an operation direction along a first portion terminating in a second portion extending generally perpendicular to the first portion; and abutting the bag received in the fixture with a stationary guide as the fixture moves between the first and second portions for preventing the bag from moving from the fixture under centrifugal forces, with the fixture moving relative to the stationary guide in the operation direction.

43. Method for filling a bag having an unsealed end, a top, and a bottom comprising the steps of:

moving a fixture for receipt of the bag at intermittent positions in an operation direction along a closed loop shape having a first, generally vertical portion terminating in a second, generally horizontal portion in turn terminating in a third, generally vertical portion terminating in a fourth portion in turn terminating in the first portion; loading the bag into the fixture in the first portion; filling the bag loaded in the fixture in the second portion; sealing the bag loaded in the fixture in the second portion; and ejecting the bag from the fixture in the third portion.

44. The method of claim 43 wherein the step of loading the bag comprises the steps of:

folding the bag about a fold line with a first portion of the bag having the top overlying the top of a second portion of the bag; and inserting the folded bag into the fixture.

* * * * *